US010988333B2

(12) United States Patent
Somano et al.

(10) Patent No.: US 10,988,333 B2
(45) Date of Patent: Apr. 27, 2021

(54) PRINTING APPARATUS

(71) Applicant: CANON KABUSHIKI KAISHA, Tokyo (JP)

(72) Inventors: Toshiaki Somano, Tokyo (JP); Kosuke Yamamoto, Yokohama (JP); Norio Sakurai, Tokyo (JP); Yuki Emoto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/866,696

(22) Filed: May 5, 2020

(65) Prior Publication Data

US 2020/0262666 A1 Aug. 20, 2020

Related U.S. Application Data

(63) Continuation of application No. 16/394,243, filed on Apr. 25, 2019, now Pat. No. 10,683,181.

(30) Foreign Application Priority Data

May 18, 2018 (JP) ..... JP2018-096113

(51) Int. Cl.
*B41J 2/135* (2006.01)
*B65H 5/06* (2006.01)
*B65H 5/00* (2006.01)

(52) U.S. Cl.
CPC ..... *B65H 5/06* (2013.01); *B41J 2/135* (2013.01); *B65H 5/006* (2013.01)

(58) Field of Classification Search
CPC ..... B65H 2601/26; B65H 2601/325; B65H 2553/612; B65H 2404/63; B65H 2404/693; B65H 43/06; B65H 29/52; B65H 2801/06; B65H 31/02; B65H 5/06; B65H 5/006; B41J 2/135
See application file for complete search history.

(56) References Cited

U.S. PATENT DOCUMENTS

| | | | | |
|---|---|---|---|---|
| 10,683,181 | B2 * | 6/2020 | Somano | B65H 29/52 |
| 2015/0145203 | A1 | 5/2015 | Kobayashi | |
| 2018/0117929 | A1 | 5/2018 | Nakamura | |
| 2018/0362277 | A1 | 12/2018 | Kano | |

FOREIGN PATENT DOCUMENTS

JP 2000-219397 A 8/2000

* cited by examiner

*Primary Examiner* — Kristal Feggins
(74) *Attorney, Agent, or Firm* — Venable LLP

(57) ABSTRACT

A printing apparatus includes a displacement member configured to be in contact with discharged print media and be displaced according to the amount of a stack of the print media, and detects the stack amount based on the displacement of the displacement member. The apparatus performs a first or second detection operation based on the detected stack amount. In the first detection operation, after a specified number of print media are discharged with the displacement member positioned at the evacuation position where it does not come into contact with a print medium, the displacement member is brought into contact with the print media to detect the stack amount. In the second detection operation, the stack amount is detected with the displacement member in contact with the print media.

25 Claims, 20 Drawing Sheets

| FIRST SENSOR 215a | SECOND SENSOR 215b | STACK AMOUNT |
|---|---|---|
| OFF | OFF | LESS THAN 14 mm |
| ON | OFF | 14 mm OR MORE AND LESS THAN 33 mm (NEARLY FULL STACK) |
| ON | ON | 33 mm or MORE (FULL STACK) |
| OFF | ON | ARM RETRACTED |
FIG.13A
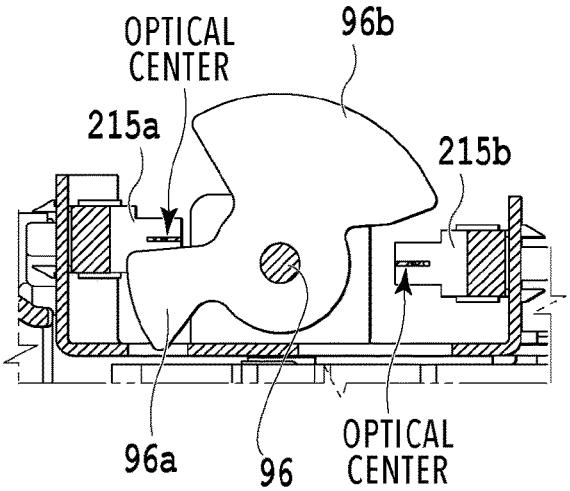
FIG.13B
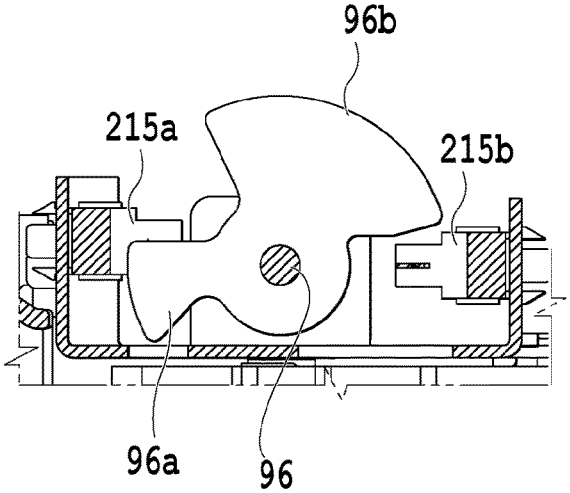
FIG.13C
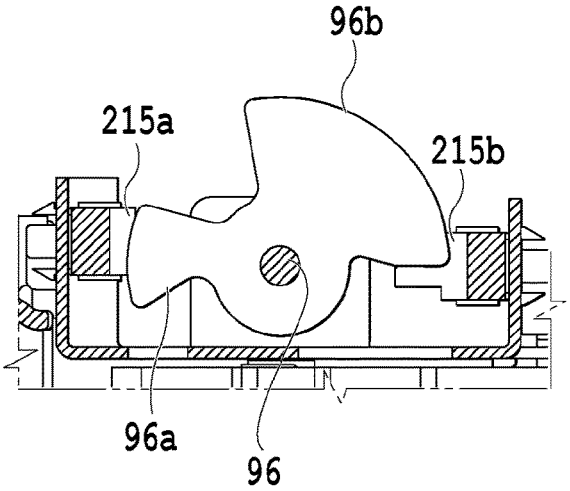
FIG.13D
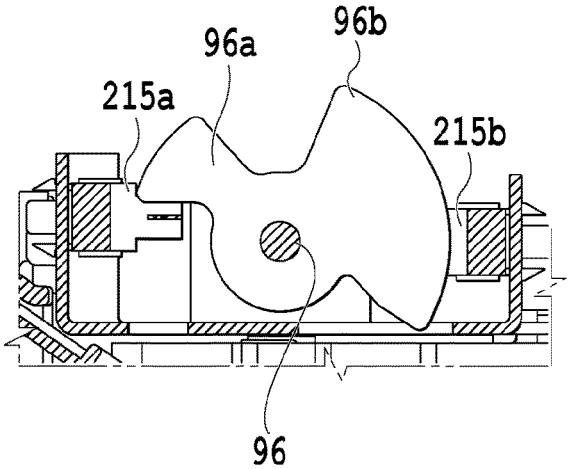
FIG.13E

| FIG.16A |
| --- |
| FIG.16B |

| FIG.18A |
| --- |
| FIG.18B |

PRINTING APPARATUS

This application is a continuation of application Ser. No. 16/394,243, filed Apr. 25, 2019.

BACKGROUND OF THE INVENTION

Field of the Invention

The present invention relates to printing apparatuses in which print media after printing are discharged and stacked.

Description of the Related Art

Japanese Patent Laid-Open No. 2000-219397 (hereinafter also referred to as patent document 1) discloses a sheet discharging apparatus including an arm member that detects the amount of a stack of print media and discloses the structure of the arm member that is movable between a pressing position where the arm member presses the stacked print media and a remote position where it is away from the stacked print media. According to the description, this arm member uncurls the print medium at the pressing position and also detects the amount of the stack of print media.

According to patent document 1, when a print medium is newly stacked, the arm member is moved to the pressing position to press the print medium for a specified time, and then the arm member is moved to the remote position to move the arm member away from the print medium. As described above, in a technique in patent document 1, the arm member, for every discharged print medium, has to be moved away from the print medium after pressing the arm member against the print medium. For this reason, the movement of the arm member for a discharged print medium has to be taken into account to perform printing, and thus it has been difficult to increase the print speed.

SUMMARY OF THE INVENTION

The present invention provides a technique that makes it possible to detect the stack amount and also increase the print speed.

In the first aspect of the present invention, there is provided a printing apparatus comprising:

a print head configured to perform printing on a print medium;

a conveying unit configured to convey a print medium;

a stacking unit configured to stack a print medium that is printed by the print head and discharged by the conveying unit;

a displacement member configured to be in contact with a print medium stacked on the stacking unit and be displaced based on an amount of a stack of the print media;

a detection unit configured to detect the amount of the stack based on the displacement of the displacement member; and a movement unit configured to move the displacement member to an evacuation position where the displacement member does not come into contact with a print medium being discharged onto the stacking unit, wherein based on the amount of the stack detected by the detection unit, the printing apparatus performs a first detection operation in which after a specified number of print media are discharged onto the stacking unit with the displacement member positioned at the evacuation position, the detection unit detects the amount of the stack using the displacement member or a second detection operation in which the amount of the stack is detected with the displacement member in contact with print media stacked on the stacking unit.

The present invention provides a printing apparatus capable of high-speed printing.

Further features of the present invention will become apparent from the following description of exemplary embodiments with reference to the attached drawings.

BRIEF DESCRIPTION OF THE DRAWINGS

FIGS. 13A, 13B, 13C, 13D, and 13E are diagrams for explaining detection results of sensors;

DESCRIPTION OF THE EMBODIMENTS

Figure 1:
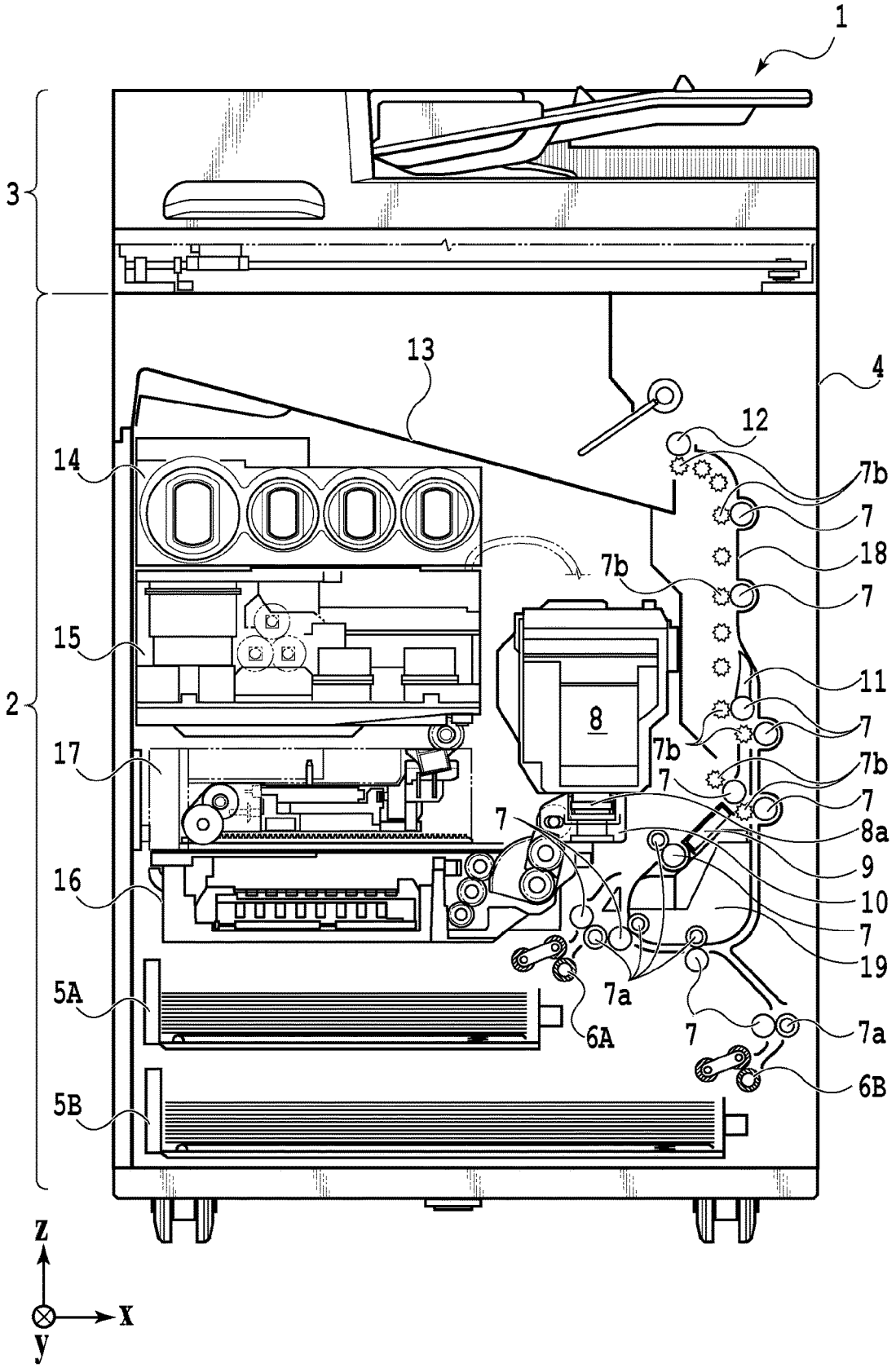
FIG. 1 is a view of a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing medium (cut sheets) S are detachably provided at the bottom of a casing 4 in the vertical direction. Relatively small printing medium of up to A4 size are stacked and housed in the first cassette 5A and relatively large printing medium of up to A3 size are stacked and housed in the second cassette 5B. A first feeding unit 6A for feeding housed printing medium one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The printing apparatus 1 has multiple motors for driving the above drive rollers, and each drive roller is connected to one of the motors. The relationship between the motors and the drive roller will be described later in detail.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 (stacking unit) is a tray for stacking and housing printing medium S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head 8 is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
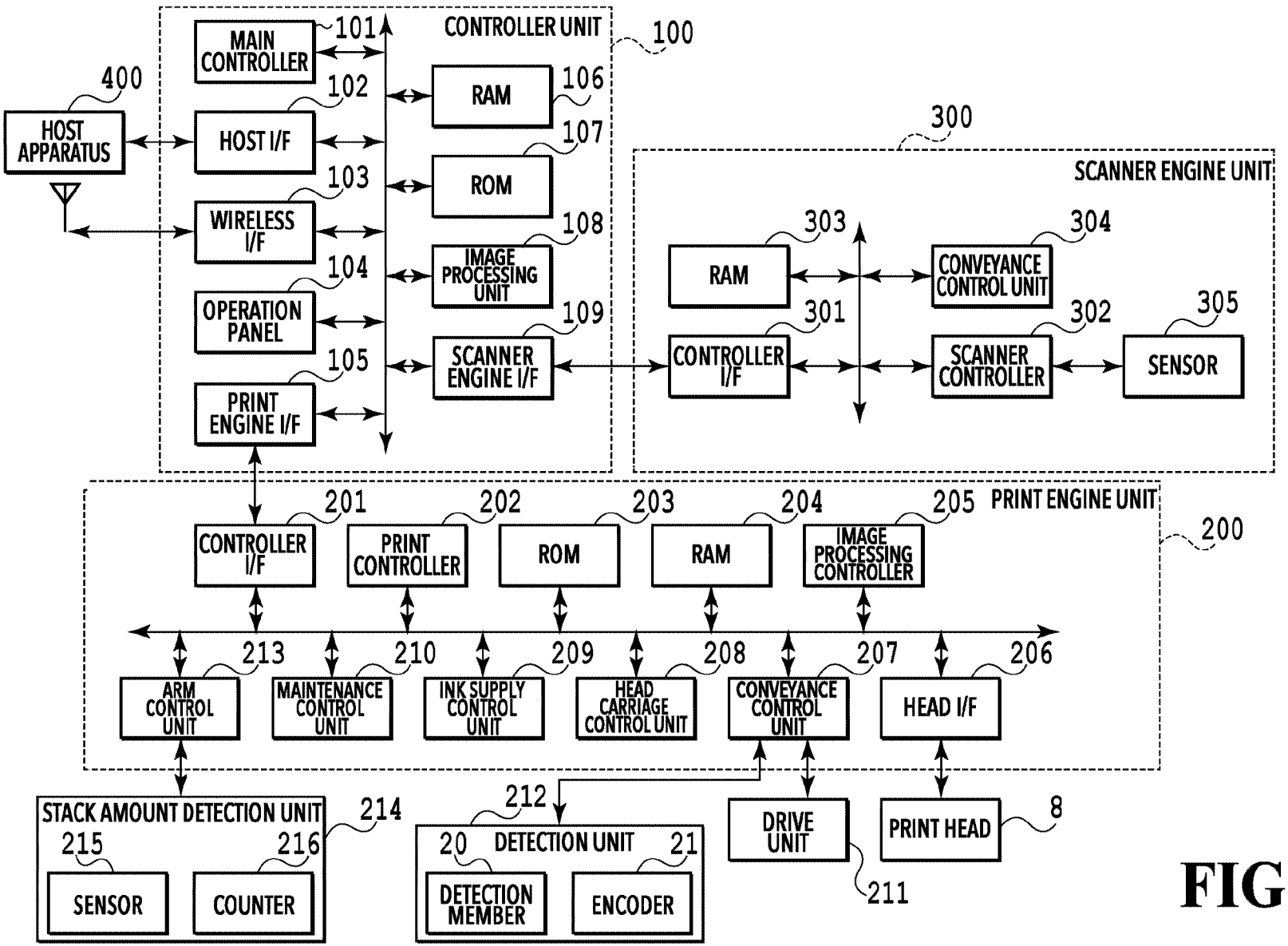
FIG. 2 is a diagram of a control configuration of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operations such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

The conveyance control unit 207, connected to the detection unit 212 for detecting the conveyance state of the printing medium S and the drive unit 211 for driving the drive rollers, controls the conveyance of the printing medium S using the drive unit 211, based on detection results obtained from the detection unit 212. The detection unit 212 has the detection members 20 for detecting the printing medium S and the encoders 21 for detecting the amount of rotation of the drive rollers.

Printing is performed in the course of the conveyance of the printing medium S by the conveyance control unit 207, by the print head 8 performing print operation under instructions from the print controller 202.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

The arm control unit 213 drives a flapper 91 (described later) to control the rotation of an arm 90 (described later) and moves the arm 90 to an evacuation position or a detecting position. In other words, in the present embodiment, the arm control unit 213 and the flapper 91 function as a movement unit for moving the arm 90 between the evacuation position and the detecting position. The arm control unit 213 is connected to a stack amount detection unit 214. The stack amount detection unit 214 includes sensors 215 for detecting the amount of a stack of print media S on the discharging tray 13 based on the displacement (rotation) of the arm 90 (displacement member). The stack amount detection unit 214 includes a counter 216 to count the number of discharged print media S based on the detection results by the detection member 20 disposed near a discharge opening 95.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operations based on the image data scanned by the scanner controller 302.

Figure 3:
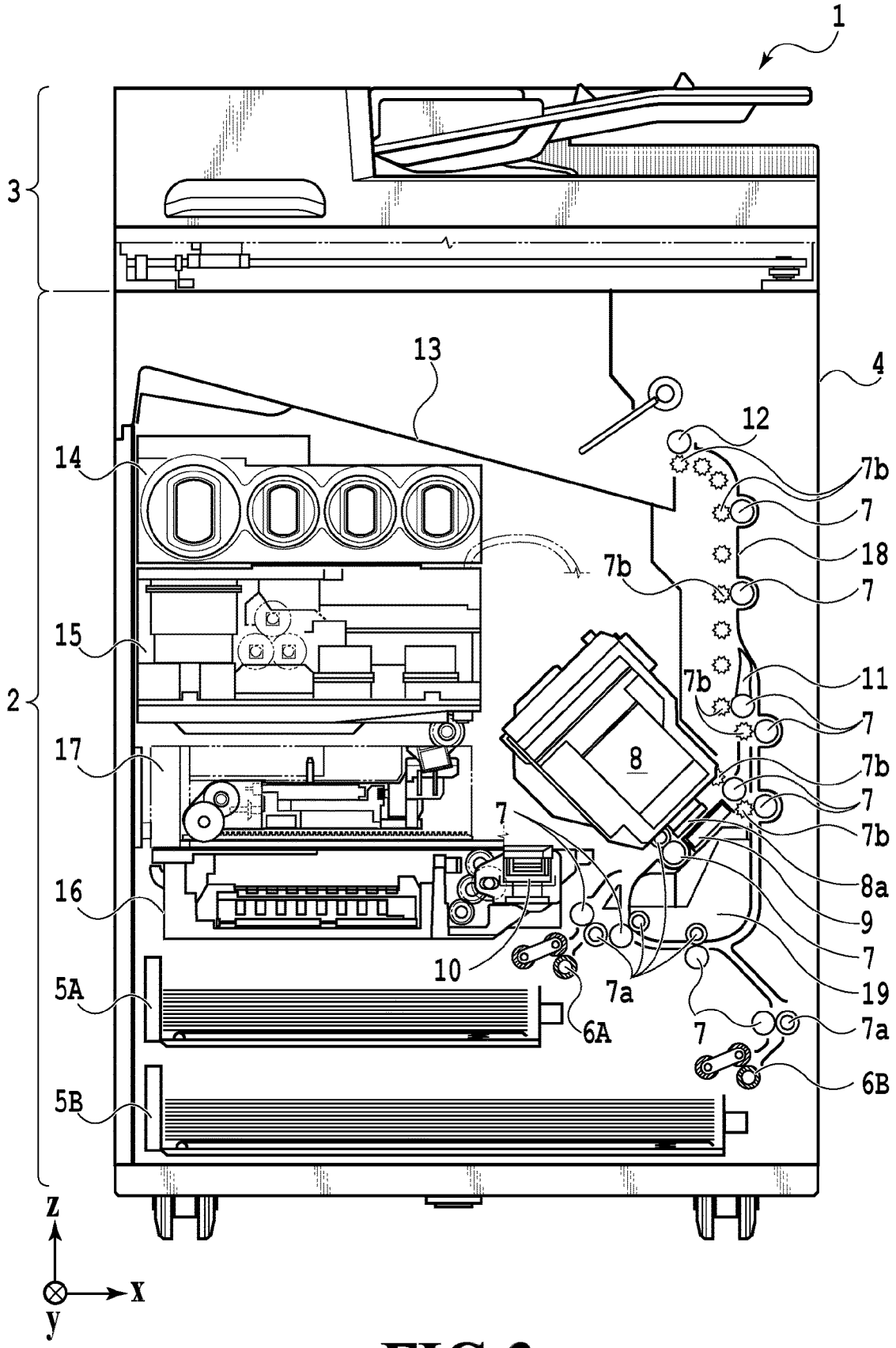
FIG. 3 is a view of the printing apparatus in a print state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
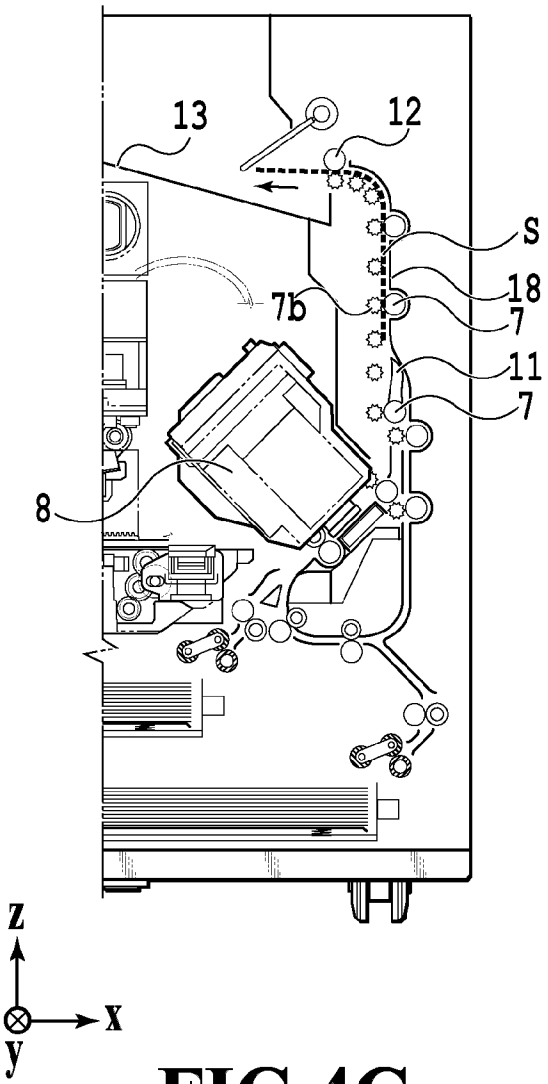
FIG. 4A, FIG. 4B, and FIG. 4C are views of a conveying path of a print medium fed from a first cassette.
Figure 4B:
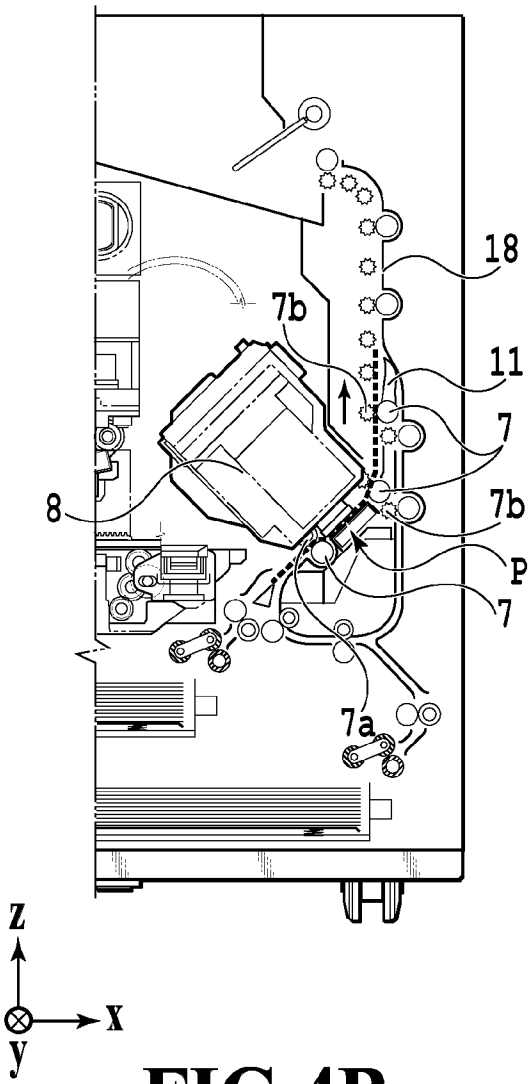
Figure 4A:
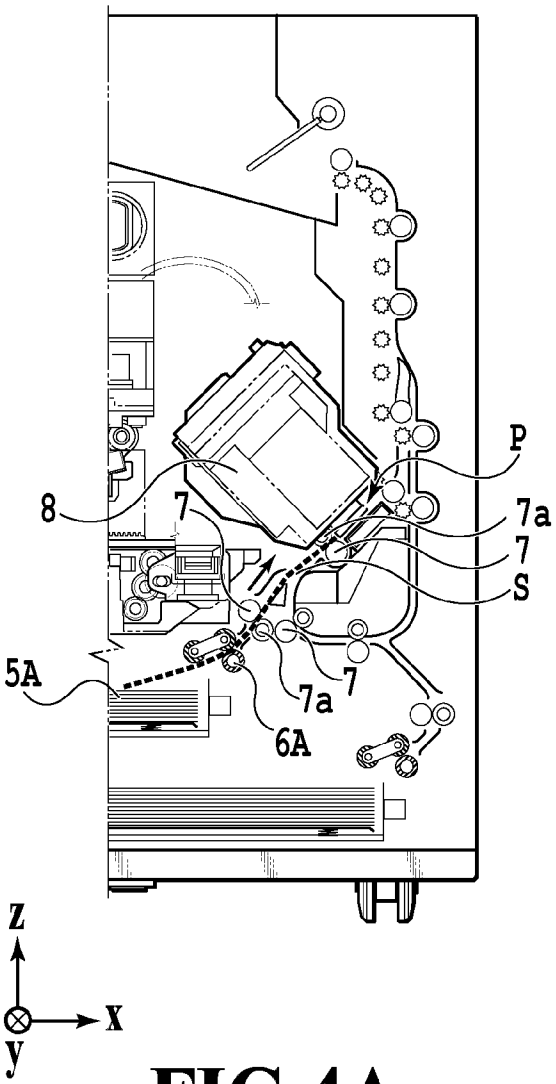

FIGS. 4A to 4C are diagrams showing a conveying path in the case of feeding an A4 size print medium S from the first cassette 5A. A print medium S at the top of a stack of printing medium in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the leading edge of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the leading edge of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the leading edge of the print medium S has passed through the discharging roller 12 and the print medium S is being discharged into the discharging tray 13. The discharged print medium S is held in the discharging tray 13 with the side on which an image was printed by the print head 8 down.

Figure 5C:
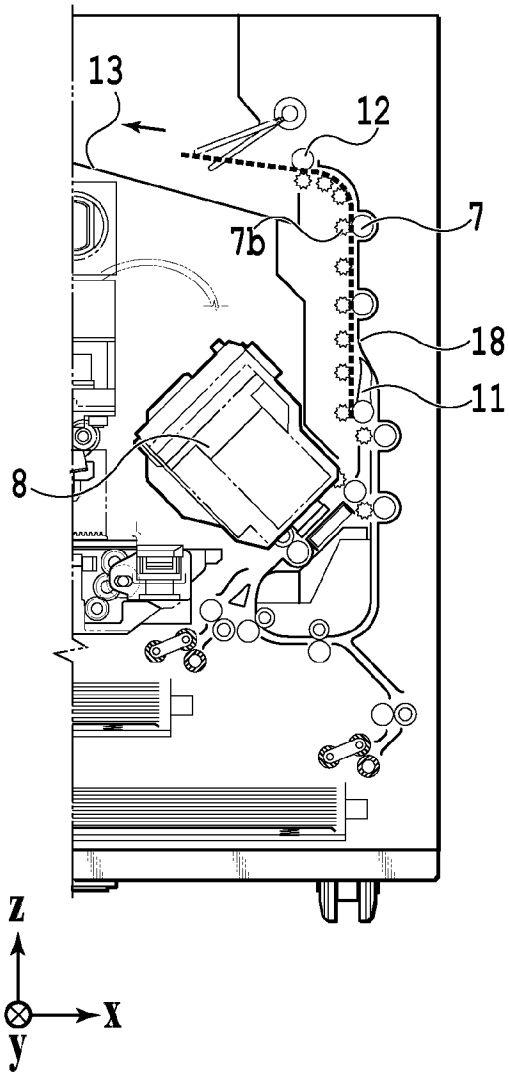
FIG. 5A, FIG. 5B, and FIG. 5C are views of a conveying path of a print medium fed from a second cassette.
Figure 5B:
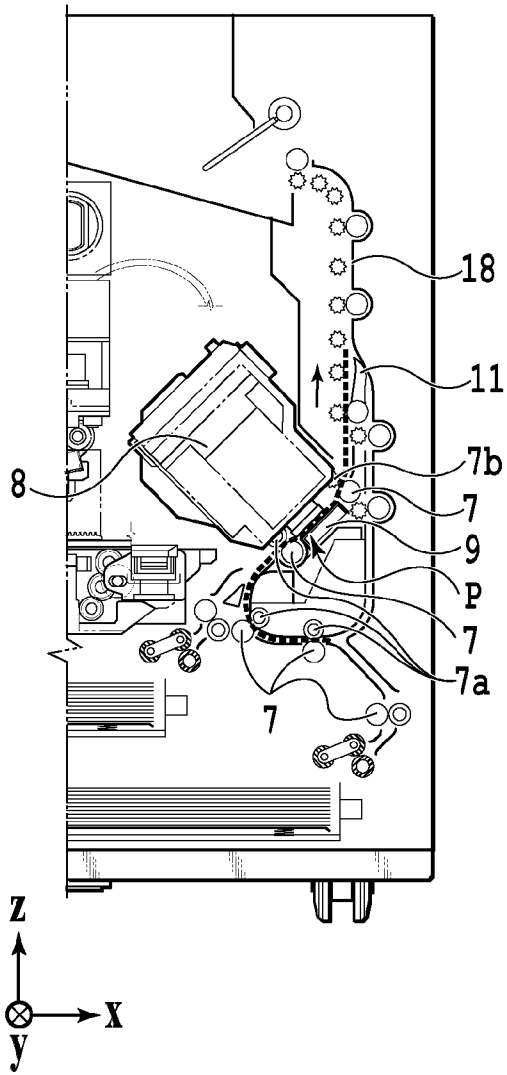
Figure 5A:
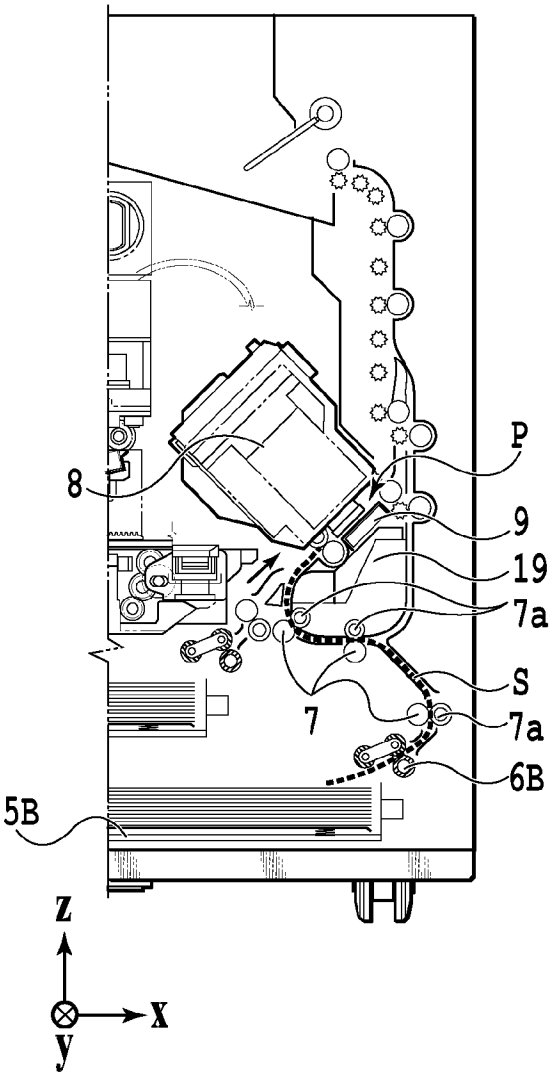

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the leading edge of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the leading edge of the print medium S has passed through the print area P and the print medium S is being conveyed vertically upward. FIG. 5C shows a state where the leading edge of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
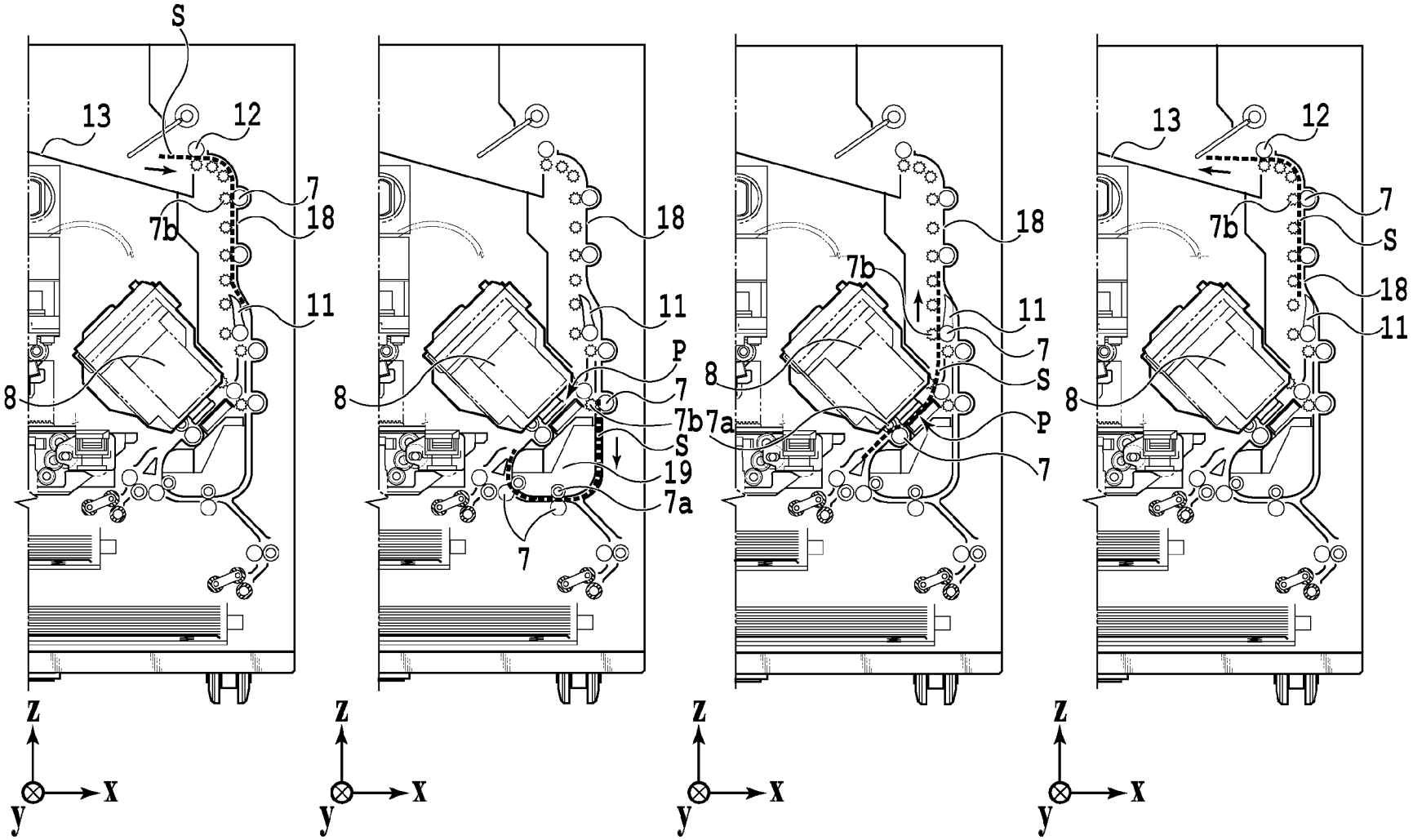
FIG. 6A, FIG. 6B, FIG. 6C, and FIG. 6D are views of a conveying path used in a case of performing a print operation on the back surface of a print medium.

After the print head 8 finishes print operation for the first side and the trailing edge of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the leading edge of the print medium S (corresponding to the trailing edge during the print operation for the first side) passes on the right of the flapper 11 and is conveyed vertically downward. FIG. 6A shows a state where the leading edge of the print medium S (corresponding to the trailing edge during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the leading edge of the print medium S is about to reach the print area P for print operation for the second side.

The rest of the conveying path is the same as that in the case of the print operation for the first side shown in FIGS. 4B and 4C. FIG. 6C shows a state where the leading edge of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the leading edge of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
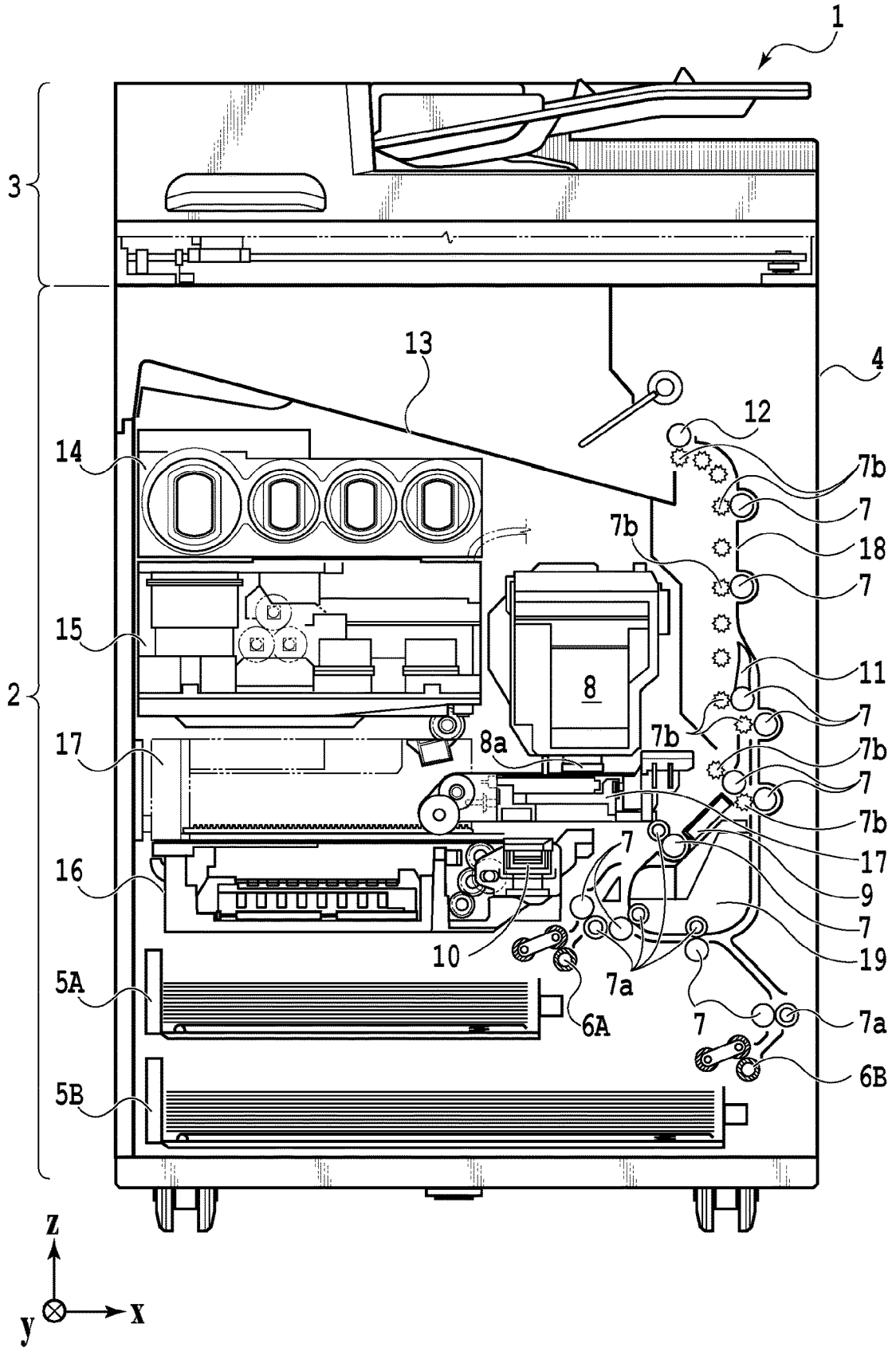
FIG. 7 is a view of the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8:
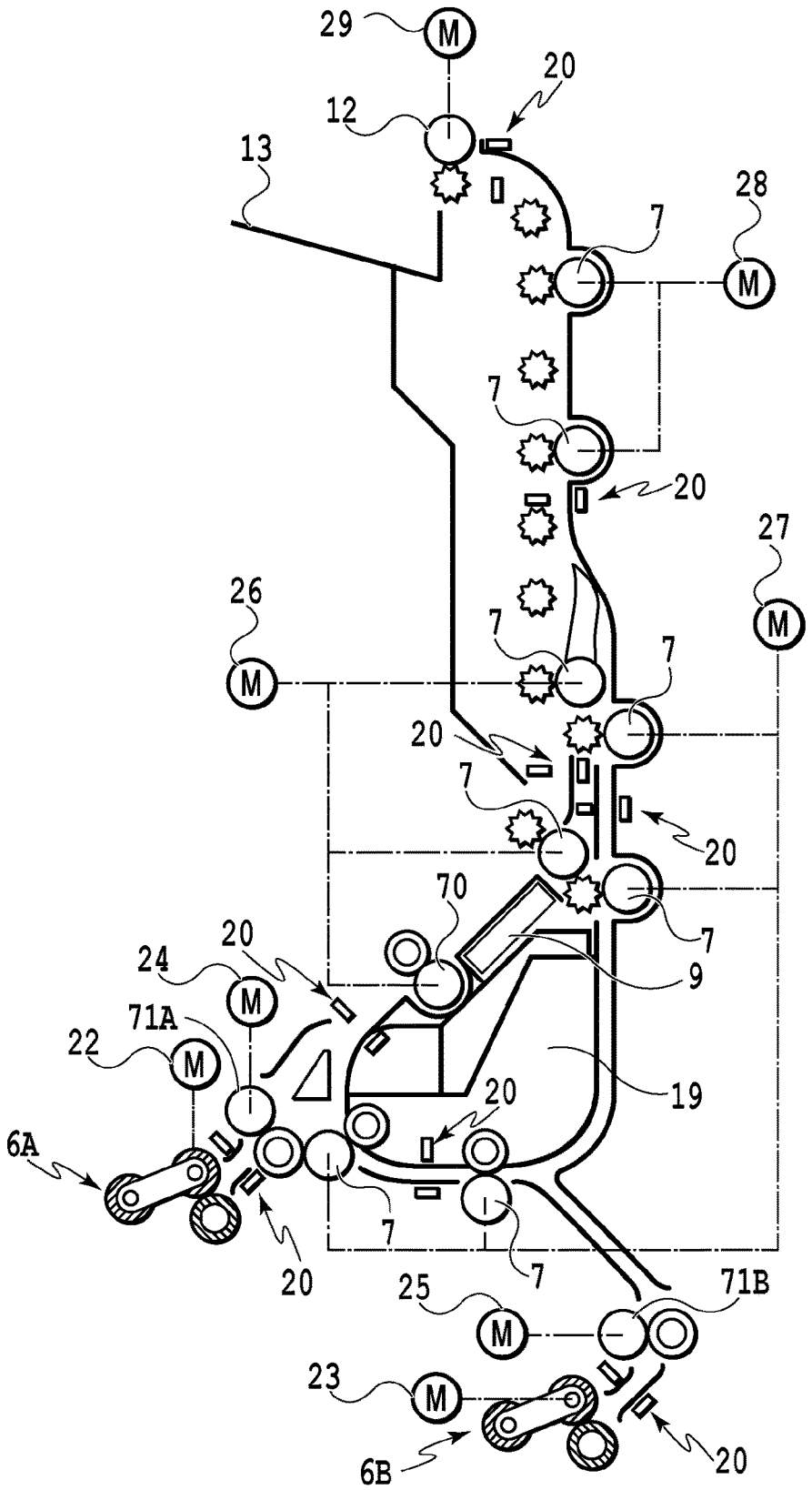
FIG. 8 is a diagram illustrating the association between drive rollers and motors.

FIG. 8 is a diagram illustrating the association between the plurality of motors and the drive rollers in the printing apparatus 1. A first feed motor 22 drives a feed roller of the first feed unit 6A that feeds a print medium S from the first cassette 5A. A second feed motor 23 drives a feed roller of the second feed unit 6B that feeds a print medium S from the second cassette 5B. A first conveyance motor 24 drives a first intermediate roller 71A being the first roller to convey the print medium S fed from the first feed unit 6A. A second conveyance motor 25 drives a second intermediate roller 71B being the first roller to convey the print medium S fed from the second feed unit 6B.

A main conveyance motor 26 drives a main conveyance roller 70 that is disposed upstream of the platen 9 and mainly conveys a print medium S which is being printed. The main conveyance motor 26 also drives two conveyance rollers 7 that are disposed downstream of the platen 9 and convey further downstream the print medium S conveyed by the main conveyance roller 70.

A third conveyance motor 27 drives two conveyance rollers 7 that convey downward a print medium S printed on the first surface. The third conveyance motor 27 also drives two conveyance rollers 7 that are disposed along the inner guide 19 and convey, toward the print head 8, a print medium S conveyed by the second intermediate roller 71B or a print medium S printed on the first surface and flipped upside down.

A fourth conveyance motor 28 drives two conveyance rollers 7 that convey upward or downward a print medium S having finished its printing operation. A discharge motor 29 drives the discharge roller 12, which discharges a printed print medium S onto the discharge tray 13. As described above, the two feed motors 22 and 23, the five conveyance motors 24 to 28, and the discharge motor 29 are each associated with one or more drive rollers.

On the other hand, at eight positions along the conveyance paths are disposed the sensing members 20, each of which senses the presence or absence of a print medium S. Each sensing member 20 includes a sensor and a mirror disposed on the opposite sides of the conveyance path. The sensor, including a light emitting portion and a light receiving portion, is disposed on one side of the conveyance path while the mirror is disposed on the other side of the conveyance path at a position facing the sensor. Whether a print medium S is present, that is, whether its leading edge or trailing edge is passing, is determined based on whether light emitted from the light emitting portion of the sensor is reflected by the mirror and received by the light receiving portion.

The conveyance control unit 207 controls the conveyance in the entire apparatus by individually driving the feed motors 22 and 23, the conveyance motors 24 to 28, and the discharge motor 29 based on the results of sensing by the plurality of sensing members 20 and the output values of the encoders that detect the amounts of rotation of the respective drive rollers.

Figure 9A:
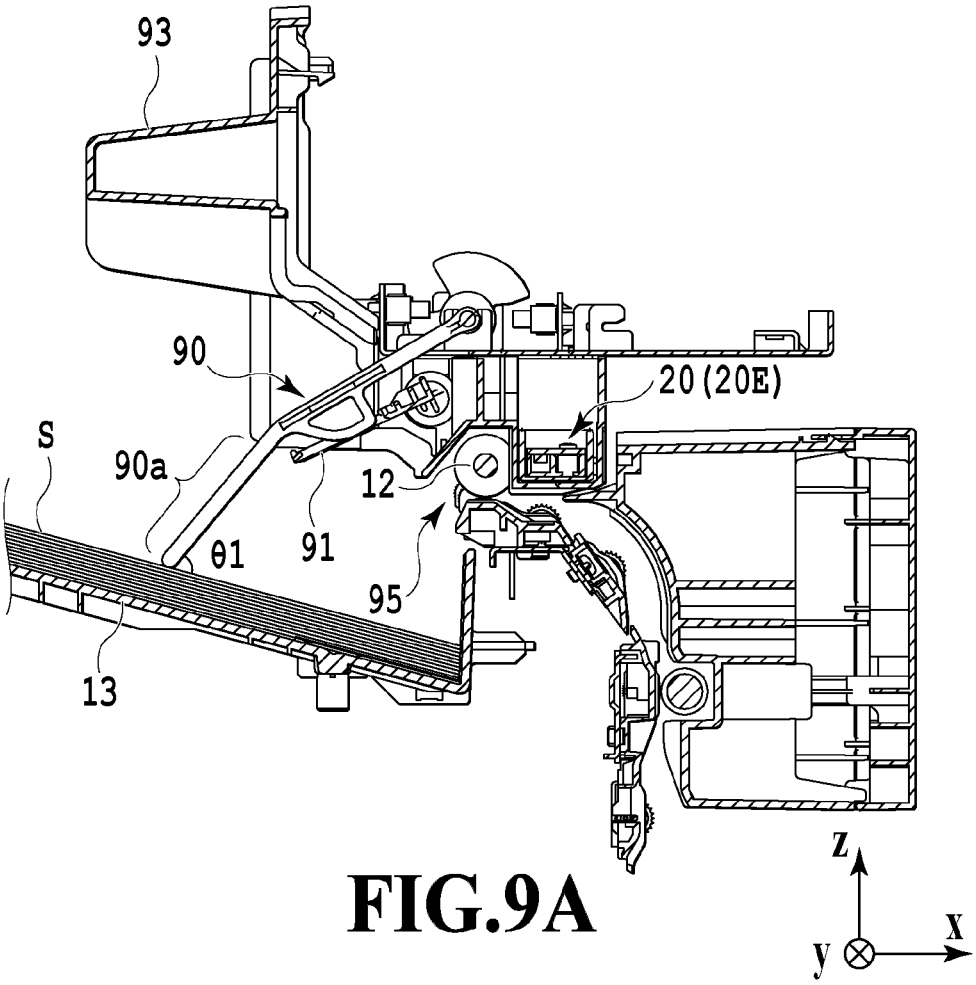
FIGS. 9A and 9B are diagrams illustrating an arm at the position when a small number of print media are stacked.
Figure 9B:
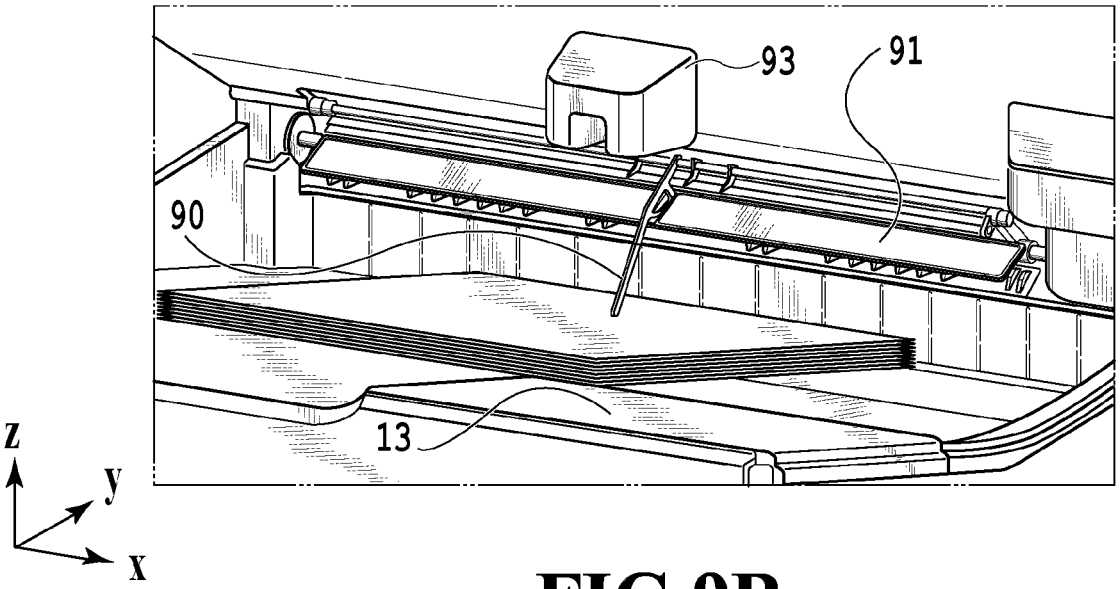
Figure 10A:
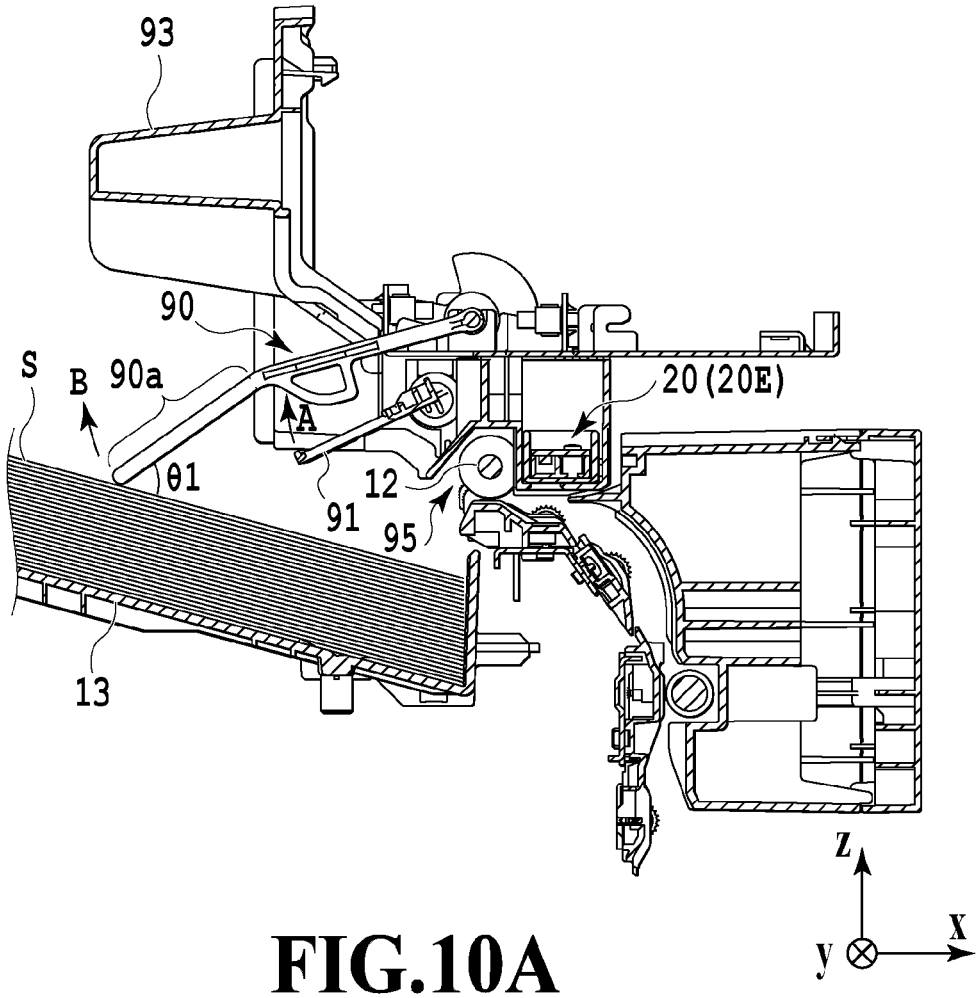
FIGS. 10A and 10B are diagrams illustrating the arm at the position when a large number of print media are stacked.
Figure 10B:
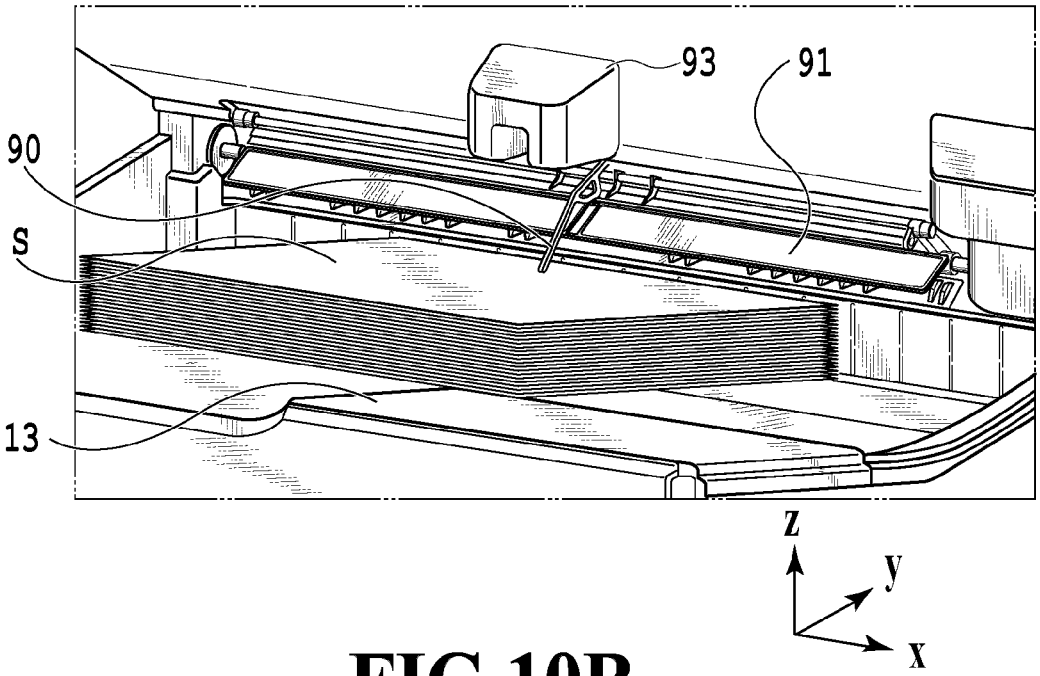

Next, description will be provided for the structure for detecting the amount of a stack of print media S on the discharging tray 13. FIG. 9A is a cross-sectional view of the discharge opening 95 and its periphery in a case where a relatively small number of print media S are stacked on the discharging tray 13. FIG. 9B is a perspective view of the discharge opening 95 and its periphery. FIG. 10A is a cross-sectional view of the discharge opening 95 and its periphery in a case where a relatively large number of print media S are stacked on the discharging tray 13. FIG. 10B is a perspective view of the discharge opening 95 and its periphery. Note that in FIGS. 9A, 9B, 10A, and 10B, the arm 90 is positioned at the detecting position where it can detect the amount of a stack of print media S on the discharging tray 13.

The printing apparatus 1 includes the arm 90 to detect the amount of a stack of print media S on the discharging tray 13 and the flapper 91 that rotates the arm 90 and is also capable of restraining curling of the discharged print medium S, near the discharge opening 95 through which the print medium S is discharged by the discharging roller 12. The arm 90 is rotatable, and its rotation center is above the discharge opening 95. The arm 90 is movable between the detecting position where the distal end of the arm 90 can come into contact with the print media S stacked on the discharging tray 13 by its rotating and the evacuation position where the arm 90 does not come into contact with the print medium S being discharged from the discharge opening 95. The arm 90 includes a distal end portion 90*a* that comes into contact with the print medium S discharged from the discharge opening 95, and in a case where the arm 90 is at the detecting position, angle θ1 formed by the distal end portion 90*a* and the print media S stacked on the discharging tray 13 is an acute angle as illustrated in FIG. 9A.

In the present embodiment, in a case where the arm 90 is at the detecting position, and a certain number or more of print media S (for example, 50 sheets or more) are stacked on the discharging tray 13, the distal end of the arm 90 is in contact with the print medium S. Note that the structure may be such that in a case where the arm 90 is at the detecting position, the distal end of the arm 90 is in contact with the print media S stacked on the discharging tray 13 (with the discharging tray 13 if there is no print medium S) regardless of the amount of a stack of print media S on the discharging tray 13.

The flapper 91 is rotatable, and its rotation center is between the rotation center of the arm 90 and the discharge opening 95 in the z-direction. Rotating of the flapper 91 is controlled by a drive unit (not illustrated) driven by the arm control unit 213. The arm 90 and the flapper 91 are separate members, so that the arm 90 and the flapper 91 can operate separately. Note that the arm 90 can come into contact with and move away from the flapper 91 via a cam portion 92 (see FIG. 12) provided on the arm 90.

As illustrated in FIGS. 9B and 10B, the flapper 91 extends in the y-direction and has a length longer than that of the discharge opening 95 in the y-direction, and thus extends over the entire discharge opening 95 in the y-direction. The arm 90 is located at an approximately center of the flapper 91 in the y-direction.

Figure 11A:
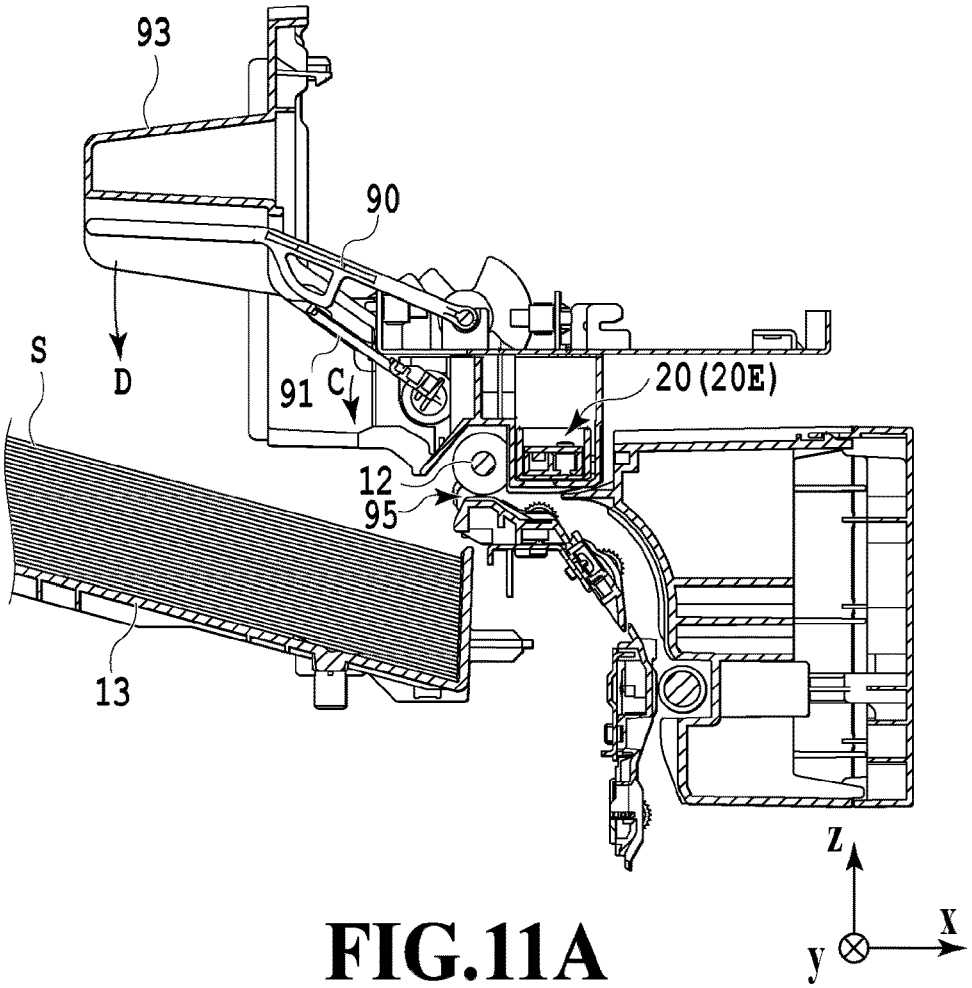
FIGS. 11A and 11B are diagrams illustrating the arm and a flapper when the arm is at an evacuation position.
Figure 11B:
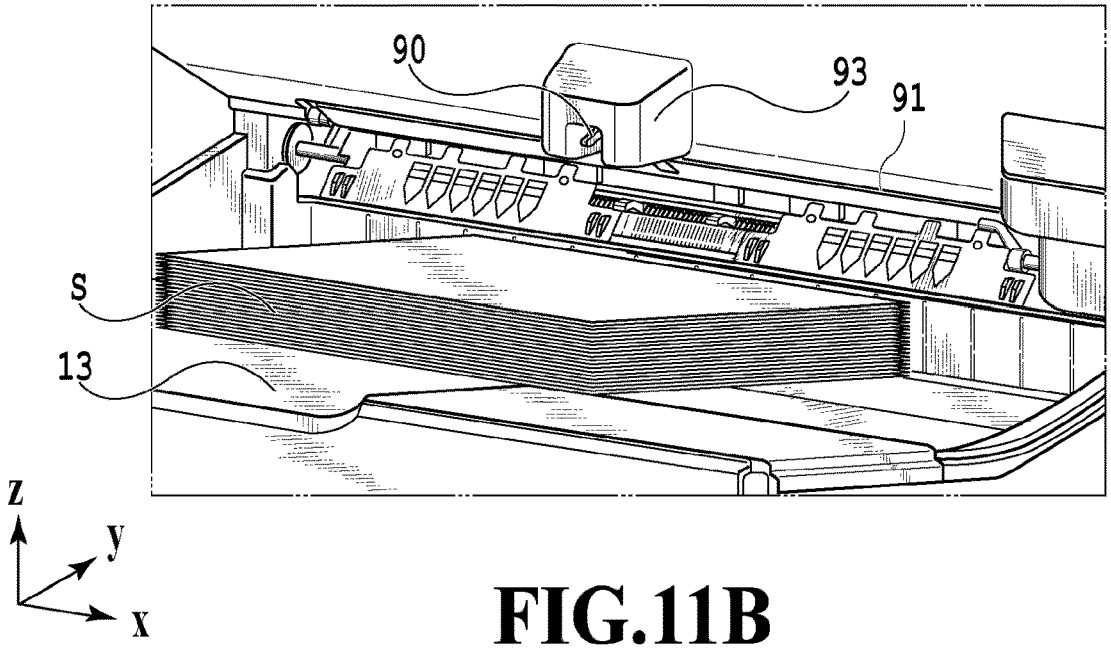
Figure 12:
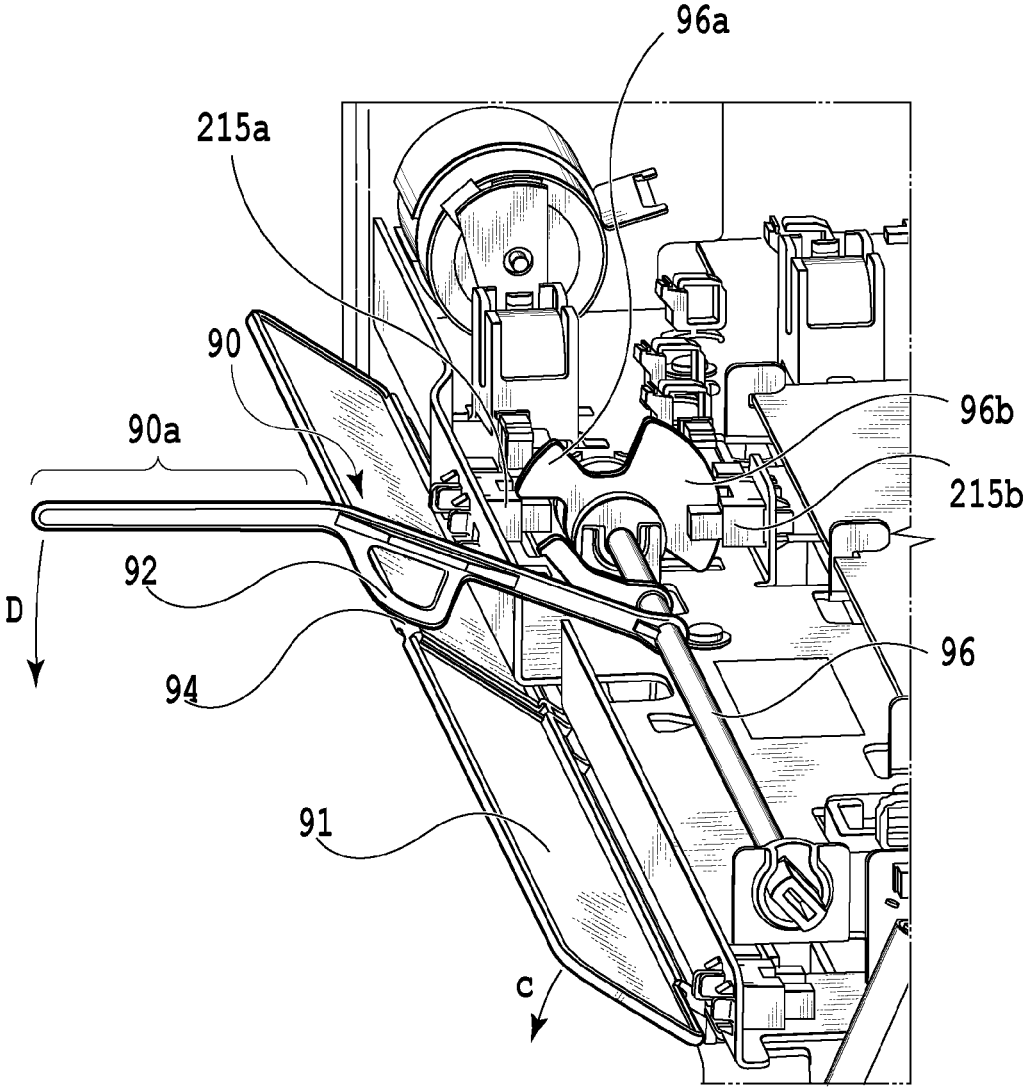
FIG. 12 is a perspective view of a schematic structure of the arm and its periphery.

FIG. 11A is a cross-sectional view of the discharge opening 95 and its periphery in a case where the arm 90 is at the evacuation position. FIG. 11B is a perspective view of the discharge opening 95 and its periphery. FIG. 12 is a perspective view of a schematic structure of the arm 90 and its periphery. The evacuation position should preferably be a position where the arm 90 does not come into contact with the print medium S being discharged from the discharge opening 95 and the print media S stacked on the discharging tray 13. In addition, the evacuation position should preferably be a position where the arm 90 is less likely to interfere with the print media S or the user's hand in a case where the user removes the stacked print media S from the discharging tray 13. The arm 90 is positioned at the detecting position in a case where it detects the amount of a stack of print media S on the discharging tray 13, and the arm 90 is at the evacuation position at maintenance, removal of the print medium S, a specified timing in a full-stack detection process described later, and the like.

The flapper 91 has a guide groove 94 formed at an approximate center thereof, and the cam portion 92 provided on the arm 90 is slidably in contact with this guide groove 94. Here, the arm 90 is rotatable around a supporting shaft 96 extending in the y-direction. The cam portion 92 provided on the arm 90 protrudes downward at a position closer to the supporting shaft 96 than to the distal end portion 90*a* with which the print medium S being discharged from the discharge opening 95 comes in contact.

Thus, rotation of the flapper 91 in the arrow A direction (see FIG. 10A) causes the guide groove 94 to come into contact with the cam portion 92 of the arm 90 at the detecting position, and then, causes the arm 90 to rotate in the arrow B direction (see FIG. 10A) and move to the evacuation position with the cam portion 92 being guided by the guide groove 94. On the other hand, rotation of the flapper 91 in the arrow C direction (see FIG. 11A) causes the arm 90 to rotate from the evacuation position in the arrow D direction (see FIG. 11A) and move to the detecting position with the cam portion 92 being guided by the guide groove 94.

At the evacuation position is disposed an arm cover 93 that houses the distal end portion 90*a* of the arm 90. Thus, the arm 90 at the evacuation position is housed in the arm cover 93 so that the user cannot easily touch it. This prevents, at maintenance or removal of the print media S, the user's hand, the print media S being removed, or the like from coming in contact with the arm 90, preventing the arm 90 from being broken.

The supporting shaft 96 has a first flag 96*a* and a second flag 96*b* fixed thereto at different positions in the circumferential direction (rotation direction) of the supporting shaft 96. In other words, the first flag 96*a* and the second flag 96*b* have the same rotation center as the arm 90, so that rotation of the arm 90 causes the first flag 96*a* and the second flag 96*b* to rotate integrally with the arm 90. In addition, sensors 215 (a first sensor 215*a* and a second sensor 215*b*) are provided to detect rotation of the first flag 96*a* and the second flag 96*b*. The first sensor 215*a* detects the first flag 96*a*, and the second sensor 215*b* detects the second flag 96*b*. The sensors 215 are, for example, photo interrupters, and the on and off of the first sensor 215*a* or the second sensor 215*b* is determined based on whether the first flag 96*a* or the second flag 96*b* blocks light. This allows the sensors 215 to detect the rotation state of the arm 90, and the detection results make it possible to estimate the amount of a stack of print media S on the discharging tray 13.

Note that detection of the stack amount based on the detection results by the sensors 215 are performed, for example, by the stack amount detection unit 214. In other words, in the present embodiment, the sensors 215 and the stack amount detection unit 214 function as a detection unit capable of detecting the amount of a stack of print media S on the discharging tray 13 based on the rotation (displacement) of the arm 90. Such detection of the stack amount may be performed by the print controller 202 instead of by the stack amount detection unit 214.

Specifically, the stack amount is judged by combinations of detection results by the first sensor 215*a* and the second sensor 215*b*. FIG. 13A is a table showing the relationship between the detection results by the first sensor 215*a* and the second sensor 215*b* and the stack amount. In the first sensor 215*a* and the second sensor 215*b*, "ON" indicates that the light is blocked, and "OFF" indicates that the light is passing through. The stack amount is defined by the vertical length from the surface of the discharging tray 13 on which print media S are stacked. FIG. 13B is a diagram illustrating the state where the stack amount is less than 14 mm. In this state, both the first sensor 215*a* and the second sensor 215*b*, light toward which is not blocked, are "OFF". FIG. 13C is a diagram illustrating the state where the stack amount is more than or equal to 14 mm and less than 33 mm (what is called "nearly full stack"). In this state, the first sensor 215*a*, light toward which is blocked by the first flag 96*a*, is "ON", and the second sensor 215*b*, light toward which is not blocked by the second flag 96*b*, is "OFF". FIG. 13D is a diagram illustrating the state where the stack amount is more than or equal to 33 mm (what is called "full stack"). In this state, both the first sensor 215*a* and the second sensor 215*b*, light toward which is blocked, are "ON". FIG. 13E is a diagram illustrating the state where the arm 90 is at the evacuation position. In the state, the first sensor 215*a*, light toward which is not blocked by the first flag 96*a*, is "OFF", and the second sensor 215*b*, light toward which is blocked by the second flag 96*b*, is "ON".

Figure 14A:
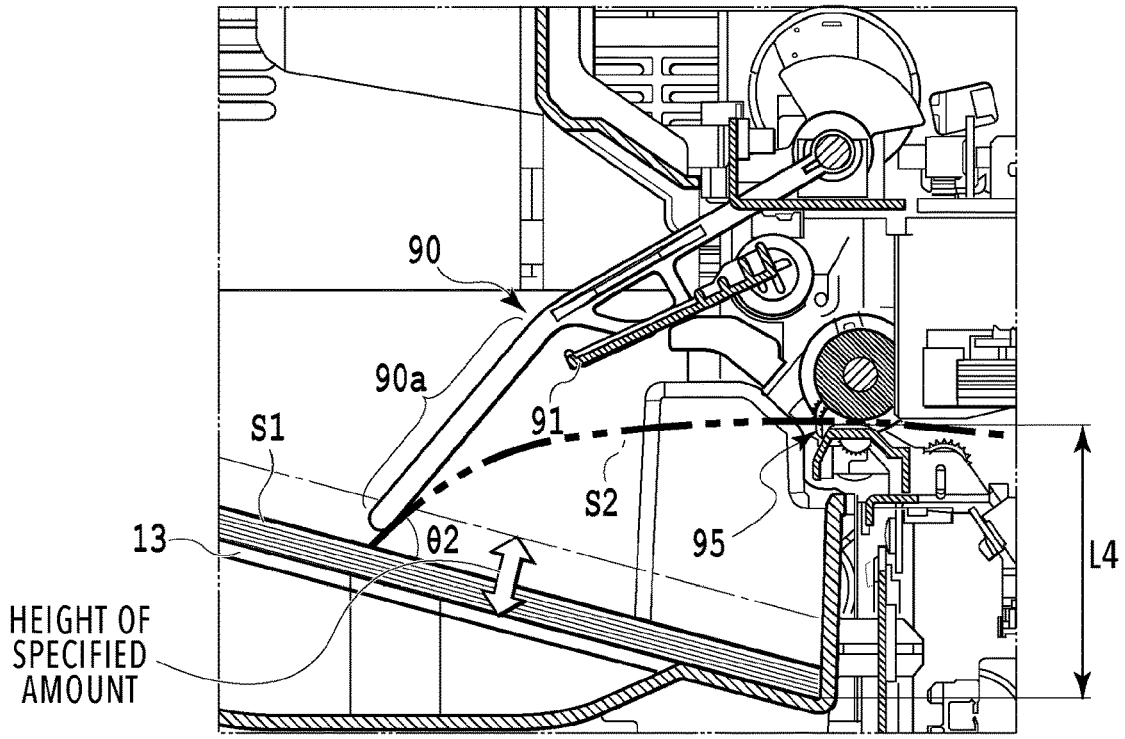
FIGS. 14A and 14B are diagrams showing contact angles of a print medium being discharged relative to stacked print media.
Figure 14B:
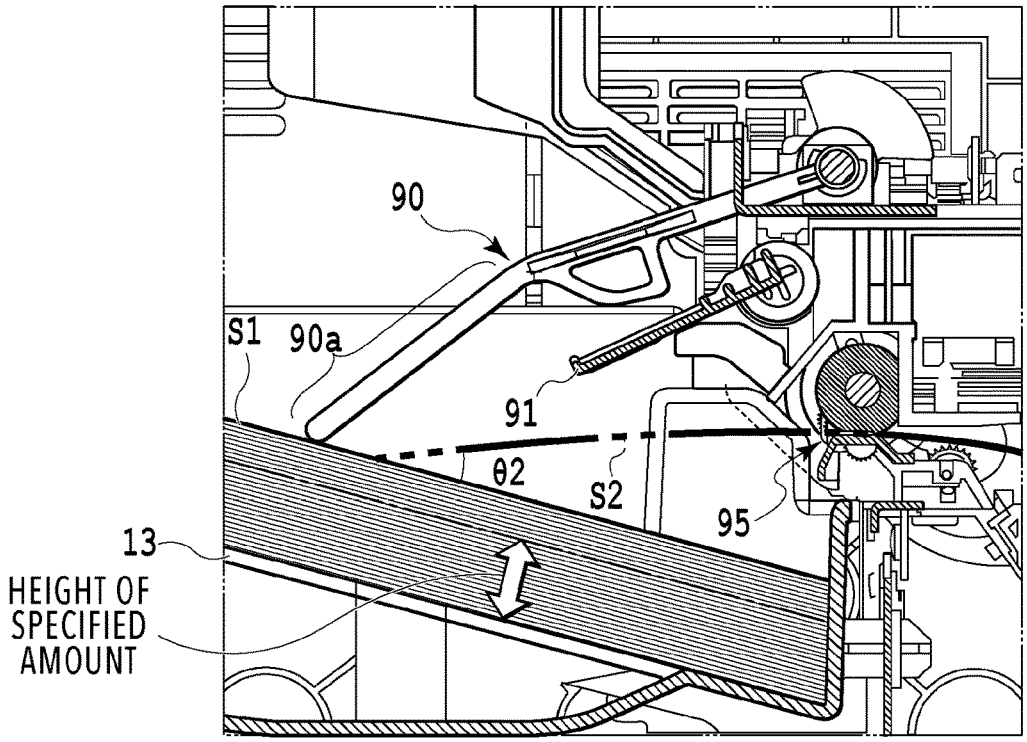

FIG. 14A is a diagram illustrating the state where a print medium S2 outputted from the discharge opening 95, being guided by the arm 90, is discharged onto print media S1 stacked on the discharging tray 13. FIG. 14B is a diagram illustrating the state where a print medium S2 is discharged onto stacked print media S1 without being guided by the arm 90. Note that in the following description, print media S1 mean print media S stacked on the discharging tray 13, and a print medium S2 means a print medium S that is discharged from the discharge opening 95.

As illustrated in FIG. 14A, in a case where the amount of a stack of print media S1 is low (including the case where no print medium S1 is stacked), the print medium S2 is discharged passing below the flapper 91, which holds the arm 90 at the detecting position, without coming into contact with the flapper 91. Then the print medium S2 comes into contact with the distal end portion 90*a* of the arm 90, and after that, the print medium S2, being guided by the distal end portion 90*a*, is discharged onto the discharging tray 13 or the print media S1. Since the arm 90 is in contact with the flapper 91 via the cam portion 92 only by its weight, the movement of the print medium S2 can rotate the arm 90 away from the flapper 91. Thus, the arm 90 does not obstruct the movement of the print medium S2 in the discharging direction.

On the other hand, in a case where the amount of a stack of print media S1 is higher than or equal to a certain amount as illustrated in FIG. 14B, the print medium S2 moves on the print media S1 and is discharged passing through the contact position between the arm 90 (and the flapper 91) and the print media S1. Note that in a case where the print media S1 are fully stacked, the height position (the position in the z-direction) of the trailing edge (the end on the discharge opening 95 side) of the uppermost print medium S1 is below the discharge opening 95. In a case where the print media S are fully stacked (full stack) or nearly fully stacked (nearly full stack), the arm 90 and the flapper 91 are in contact with the print media S1. Since the arm 90 and the flapper 91 are designed to be in contact with the print media S1 by their own weights, the contact force of each of them with the print medium S1 is small. In addition, the arm 90 and the flapper 91 are rotatable in the direction that allows the movement of the print medium S2 in the discharging direction. Thus, even in a case where the arm 90 is at the detecting position (in a case where the arm 90 is in contact with the print media S1), the movement of the print medium S2 being discharged on the print media S1 is not obstructed by the arm 90 or the flapper 91.

Meanwhile, in a case where the amount of a stack of print media S1 is less than a specified amount as illustrated in FIG. 14A, since the print medium S2 is discharged onto the print media S1 while being guided by the distal end portion 90*a* of the arm 90, the print medium S2 suddenly comes in contact with the print media S1. For this reason, in a case where the print medium S2 comes into contact with the print media S1, the leading edge of the print medium S2 tends to be caught on the print medium S1. Thus, the print medium S2 being discharged exerts force in the discharging direction on the print medium S1 and produces force caused by the recovering force (rigidity) of the print medium S2. This means that the print medium S2 is discharged moving on the print medium S1 while exerting the force in the discharging direction on the print medium S1.

In contrast, in a case where the amount of a stack of print media S1 is higher than or equal to the specified amount as illustrated in FIG. 14B, the print medium S2 reaches the print media S1 without being guided by the arm 90. Thus, the contact angle θ2 of the print medium S2 relative to the print media S1 is smaller than in a case where the amount of a stack of print media S1 is less than the specified amount. Accordingly, in a case where the print medium S2 comes into contact with the print media S1, the leading edge of the print medium S2 is less likely to be caught on the print media S1. In this case, the print medium S2 does not produce the force that moves (pushes out) the print medium S1 in the discharging direction, and thus the print medium S2 can move smoothly on the print medium S1. In other words, in a case where the amount of the stack of print media S1 is higher than or equal to the specified amount, the print media S1 are stacked onto the discharging tray 13 in an orderly fashion, showing a good orderly stacking property.

In a case where the amount of a stack of print media S1 is less than the specified amount, the force in the discharging direction produced by the print medium S2 pushes out the print medium S1 that the print medium S2 comes into contact with and shifts it in the discharging direction. In addition, since the print media S1 are slanted due to the slanted discharging tray 13, the pushed-out print medium S1 then goes down on the slanted print media S1. At this time, the pushed-out print medium S1 turns because the difference in the width direction in the load of friction against the print medium S1 immediately below it or the like causes a difference in the speed at both edges of the pushed-out print medium S1 in the width direction. For this reason, the pushed-out print medium S1 deviates also in the width direction. Thus, in a case where the amount of a stack of print media S1 is less than the specified amount, the print medium S2 causes the deviation of the print medium S1, decreasing the orderly stacking property. Note that the above-mentioned situation where the print medium S1 is pushed out is likely to occur in a case where print media S used are of a small size with a relatively light weight which can be move by a relatively small force, for example, A5 size or statement size (STMT size).

In light of the above, in the present invention, the arm 90 is retracted depending on the amount of a stack of print media S1 in a case of discharging print media S with specified sizes, in the full-stack detection process to detect, by using the arm 90, whether print media S1 have been fully stacked on the discharging tray 13. Specifically, in a case where the stack amount detected based on the displacement of the arm 90 is less than a specified amount, first the print medium S2 is discharged with the arm 90 retracted at the evacuation position. After a specified number of media are discharged, the arm 90 is moved to the detecting position to detect the stack amount (the first detection operation). In a case where the stack amount detected based on the displacement of the arm 90 is more than or equal to the specified amount, the arm 90 remains at the detecting position and detects the stack amount continuously while the print media S2 are being discharged (the second detection operation). Note that in the present embodiment, the specified amount is defined by the vertical length from the surface of the discharging tray 13 where the print media S are stacked.

Figure 15A:
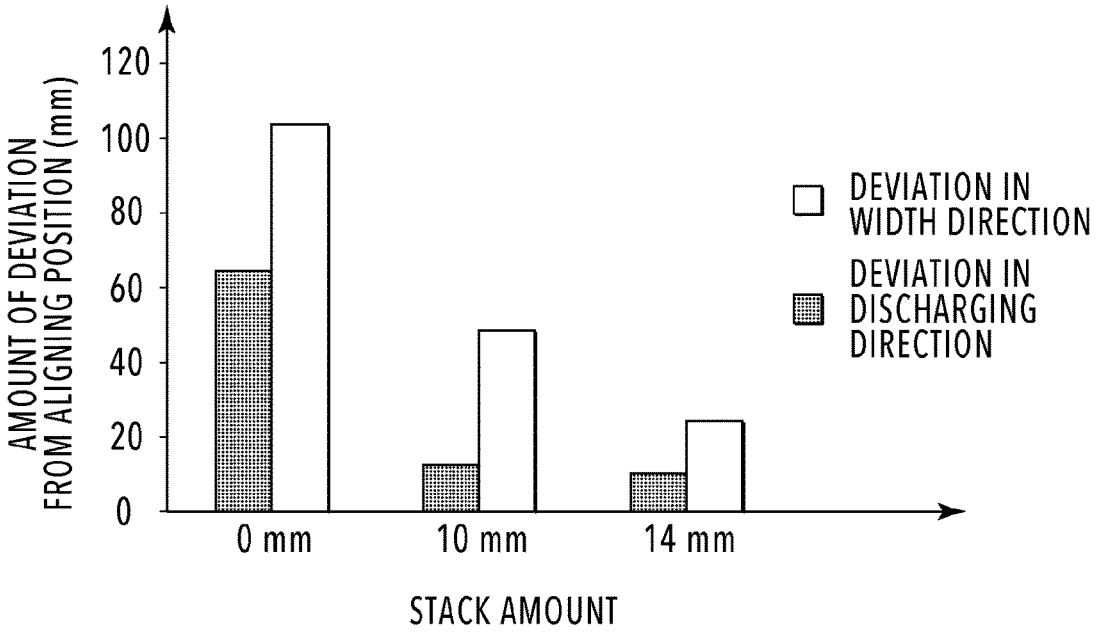
FIGS. 15A and 15B are diagrams for explaining deviation from aligning position based on a stack amount of print media.
Figure 15B:
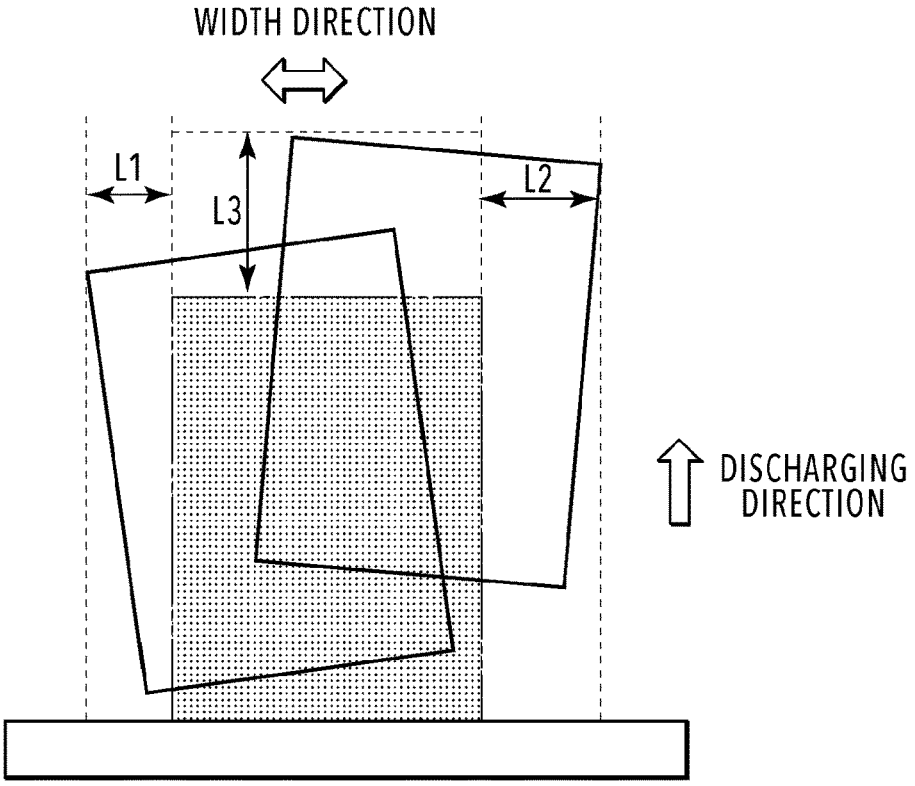

FIG. 15A is a graph illustrating a deviation from an aligning position based on the amount of a stack of print media S1. FIG. 15B is a diagram for explaining a direction and an amount of the deviation. The graph of FIG. 15A shows the direction and the amount of the deviation from aligning position in a case where 50 print media S2 are discharged on print media S1 of three different stack amount (0 mm, 10 mm, and 14 mm).

The directions of the deviation are shown as the discharging direction of the print medium S2 and the width direction of the print medium S2 orthogonal to the discharging direction as illustrated in FIG. 15B. The amount of the deviation in the width direction is expressed by the sum of values at both edges, each value indicating the distance from the edge portion of a reference print medium S1 to the edge portion of a print medium S1 furthest from the edge portion of the reference print medium S1 on the corresponding side. In other words, with respect to the reference print medium S1 (indicated by the dot pattern in the figure), the sum of the length L1 to the left edge portion of the print medium S1 that is most deviated to the left in the figure and the length L2 to the right edge portion of the print medium S1 that is most deviated to the right in the figure is defined as the amount of the deviation in the width direction. For the discharging direction, the length L3 to the edge portion of the farthest print medium S1 with respect to the reference print medium S1 is defined as the amount of the deviation in the discharging direction.

As can be seen from FIG. 15A, the more the amount of a stack of print media S1 is, the less the deviation is. In addition, for the amount of the deviation in the discharging direction, almost no change occurs from the 10-mm stack amount to the 14-mm stack amount. From these results, in the present embodiment, the specified amount that is a threshold serving as a judging criterion for moving the arm 90 from the detecting position to the evacuation position is set to 14 mm.

The specified amount is not limited to this value, but it may be changed depending on the structure of an apparatus and the type of print medium. The structure of an apparatus here includes the shape of the arm 90, the length L4 (see FIG. 14A) from the lower end of the discharging tray 13 to the discharge opening 95, the shape of the discharging tray 13, the slant angle of the discharging tray 13 relative to the print medium S2 being discharged, whether there is a measure to increase the rigidity of the print medium S, and the discharge speed of the print medium S2. Thus, the value of the specified amount is set by experimentally obtaining the amount that does not cause the print medium S1 to be pushed out by the print medium S2 by an amount exceeding an amount that is allowed (an allowable amount) (a height that is less likely to decrease the orderly stacking property, or a height that makes the contact angle θ2 of the print medium S2 relative to the print medium S1 smaller than or equal to a specified angle).

Figures 16, 16A:
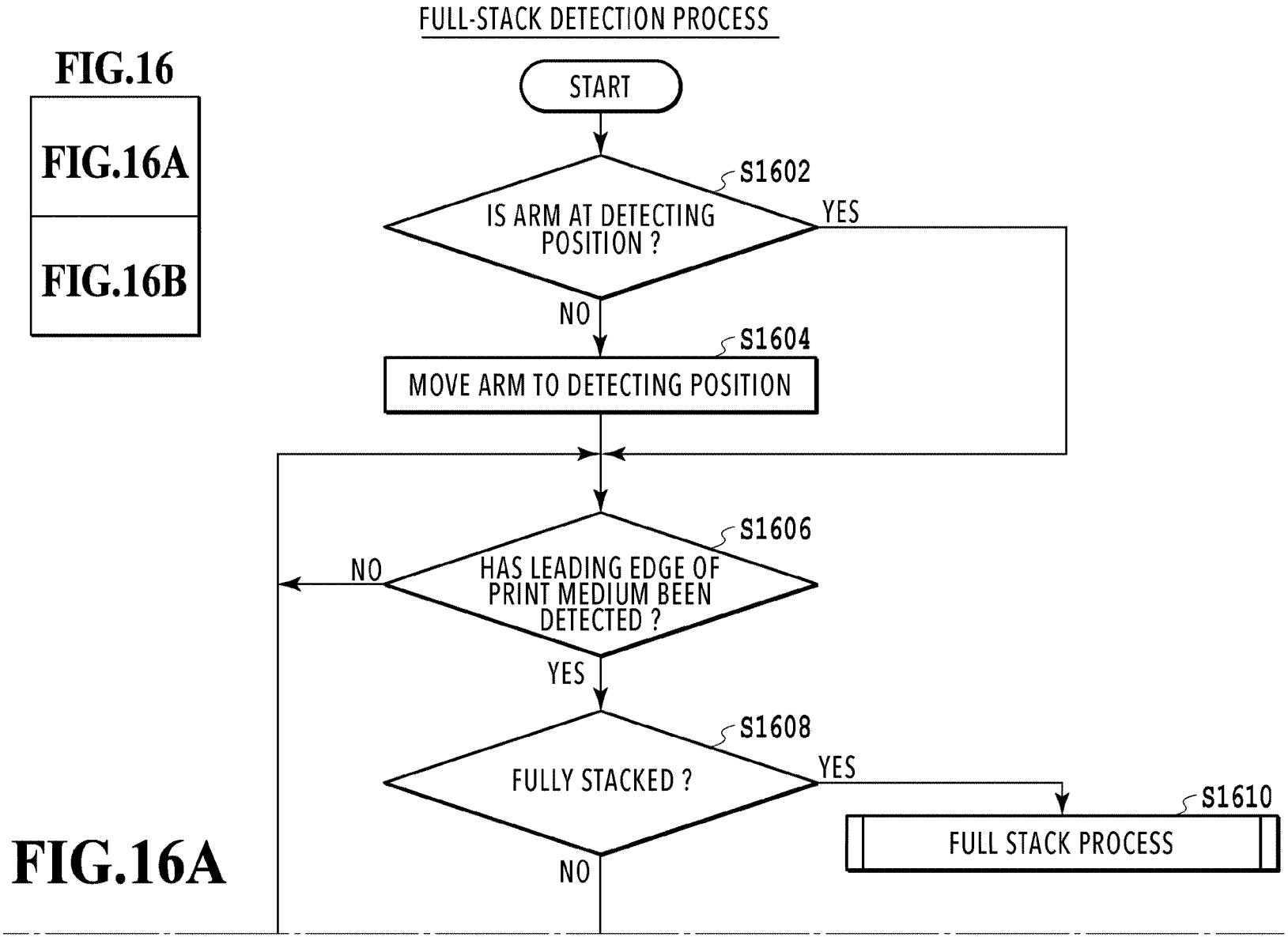
FIG. 16 is a diagram showing the relationship between FIG. 16A and FIG. 16B.
FIGS. 16A and 16B are flowcharts illustrating a detailed process routine for a full-stack detection process.
Figure 16B:
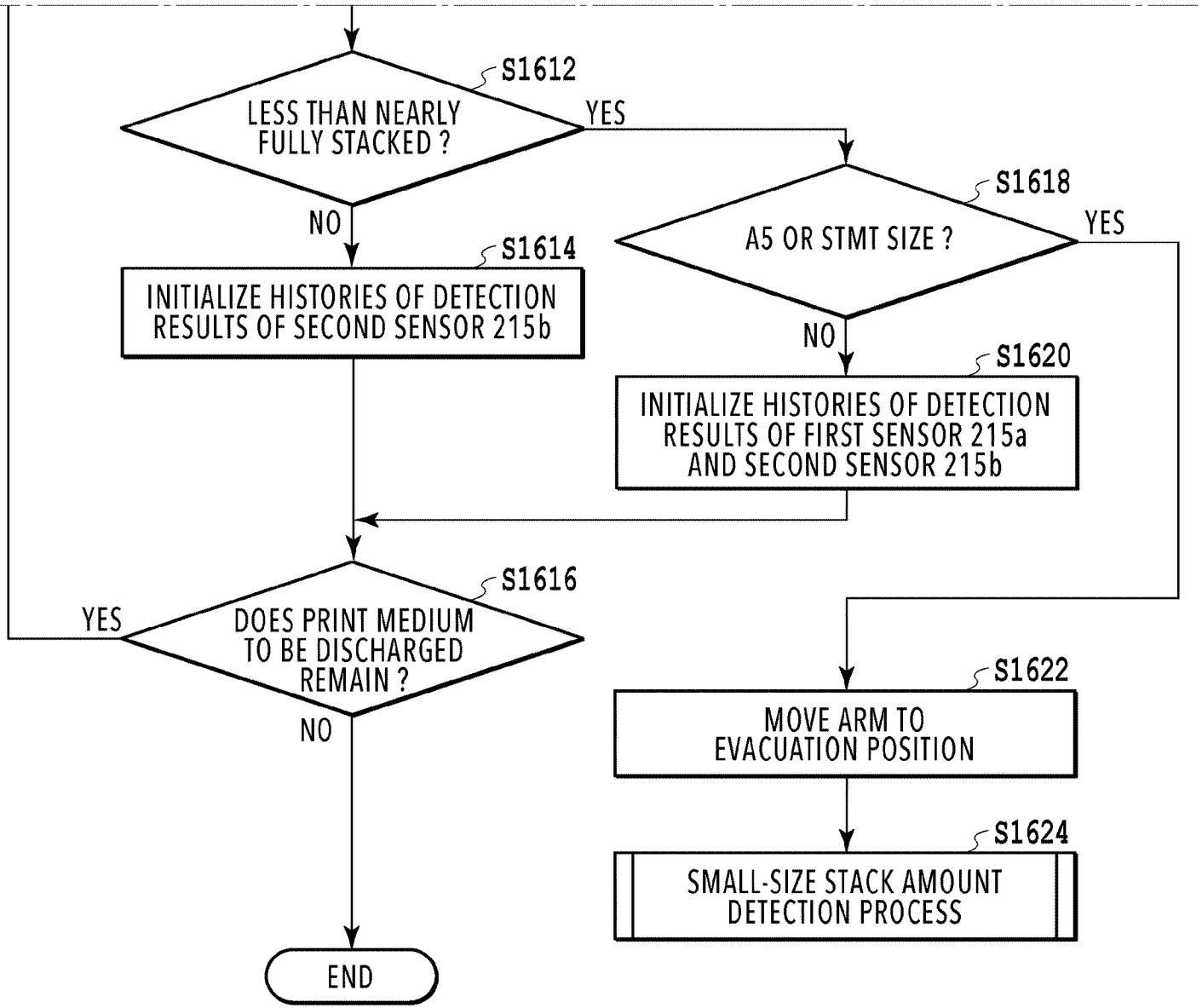

With the above structure, when print operation for the print media S starts, the full-stack detection process starts, in parallel with the print operation, for detecting whether the print media S have been fully stacked on the discharging tray 13. FIG. 16 is a flowchart illustrating detailed process contents of the full-stack detection process. A series of processes illustrated in the flowchart of FIG. 16 is executed by deploying program codes stored in the print controller 202 or the ROM 203 to the RAM 204. Alternatively, part or all of the functions in the steps in FIG. 16 may be implemented by using hardware, such as an ASIC or an electronic circuit.

When the full-stack detection process starts, first the print controller 202 judges based on detection results of the sensors 215 whether the arm 90 is at the detecting position (S1602). Specifically, at S1602, in a case where the combination of the detection results of the first sensor 215*a* and the second sensor 215*b* are (OFF, OFF), (ON, OFF), or (ON, ON), it is judged that the arm 90 is at the detecting position. In the other cases, it is judged that the arm 90 is not at the detecting position. If it is judged at S1602 that the arm 90 is at the detecting position, the process proceeds to S1606 described later. If it is judged at S1602 that the arm 90 is not at the detecting position, the arm control unit 213 moves the arm 90 from the detecting position to the evacuation position at S1604.

Next, it is judged whether the detection member 20 located near the discharge opening 95 (hereinafter, "the detection member 20 located near the discharge opening 95" is referred to as "the detection member 20E" as appropriate) has detected the leading edge of the print medium S (S1606). Note that the judgment whether the leading edge (the trailing edge) of the print medium S has been detected is made by the print controller 202 based on detection results of the detection member 20E. If it is judged at S1606 that the leading edge of the print medium S has not been detected, the process returns to 1606 again. Note that the configuration may be such that here, in a case where a certain time has passed after starting the judgment process in S1606, it is judged that jamming has occurred in the conveying path, the operating panel 104 and the like are notified that jamming has occurred, and then the full-stack detection process is terminated along with the print operation.

If it is judged at S1606 that the leading edge of the print medium S has been detected, the print controller 202 judges whether print media have been fully stacked based on detection results of the sensors 215 (S1608). In other words, the histories of the second sensor 215*b* are referred to at S1608, and if there is no history of OFF, it is judged that print media have been fully stacked. Note that the detection results of the first sensor 215*a* and the second sensor 215*b* are regularly monitored by the print controller 202 (for example, every few milliseconds). Thus, the histories of detection results for multiple times are referred to at S1608 to judge whether print media are fully stacked.

Note that in the present embodiment, to judge whether print media are fully stacked (and less than the nearly full stack amount), the histories of the first sensor 215*a* and the second sensor 215*b* are referred to. This is done because even when the stack amount is not the full stack amount, the second sensor 215*b* may turn on for a short moment in some cases, for example, in a case where the arm 90 is flipped up at the time when a discharged print medium S comes into contact with the arm 90. For this reason, the histories of detection results of the second sensor 215*b* for multiple times are referred to. In a case where the second sensor 215*b* turns on for a short moment, in other words, where only one detection result shows ON, it is not judged that print media have been fully stacked. In a case where the histories do not include a history of OFF, it is judged that print media has been fully stacked.

Figure 17:
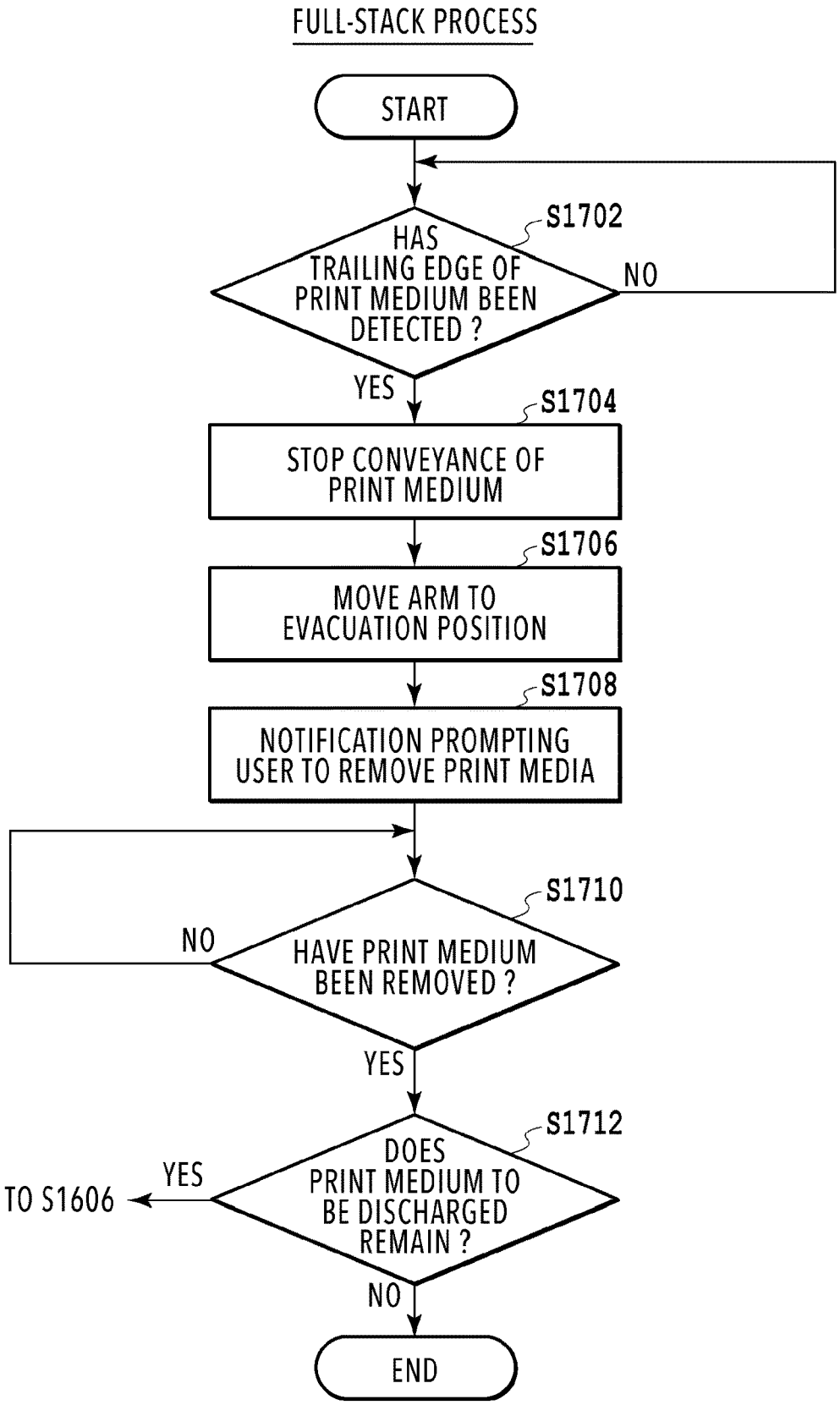
FIG. 17 is a flowchart illustrating a detailed process routine for a full-stack process.

If it is judged at S1608 that print media are fully stacked, a full-stack process is performed at S1610. Here, FIG. 17 is a flowchart illustrating the detailed process contents of the full-stack process in S1610. When the full-stack process starts, first it is judged using the detection member 20E whether the trailing edge of the print medium S has been detected (S1702). If it is judged at S1702 that the trailing edge of the print medium S has been detected, conveyance of the print medium S is stopped at S1704. At this time, if print operation is in process, the print operation is stopped. Next, the arm 90 is moved from the detecting position to the evacuation position at S1706, and at S1708, the user is given notification prompting the user to remove print media S stacked on the discharging tray 13, via the operating panel 104 or the like. After that, it is judged whether the print media S stacked on the discharging tray 13 have been removed (S1710). If it is judged the print media S have been removed, it is judged whether a print medium S to be discharged remains (S1712).

Note that the judgment at S1710 is made, for example, based on whether the user has selected a removal completion button (not illustrated) that is displayed together with the notification prompting the user to remove the print media S on the operating panel 104. The specific judgment method at S1710 is not limited to this operation. For example, a sensor (not illustrated) to detect the presence of print media S may be disposed at the discharging tray 13, and the sensor may detect removal of print media S. At S1712, it is judged using the detection members 20 including the detection member 20E whether a print medium S to be discharged remains in the conveying path. If it is judged at S1712 that a print medium S to be discharged remains, conveyance of the print medium S is resumed, and the process returns to S1606. If it is judged at S1712 that no print medium S to be discharged remains, this full-stack process ends, and the full-stack detection process ends.

Description returns to FIG. 16. On the other hand, if it is judged at S1608 that print media have not been fully stacked, the print controller 202 judges based on detection results of the sensors 215 whether the amount of a stack of print media is less than the nearly full stack amount (S1612). In other words, it is judged at S1612 whether the amount of a stack of print media S on the discharging tray 13 is less than 14 mm. Specifically, the histories of detection results of the first sensor 215*a* and the second sensor 215*b* are referred to, and if the detection result of the first sensor 215*a* is OFF, and the detection result of the second sensor 215*b* is OFF at the same timing, it is judged that the amount of a stack of print media is less than the nearly full stack amount. Note that in the other cases, it is judged that it is not less than the nearly full stack amount.

If it is judged at S1612 that it is not less than the nearly full stack amount, the histories of detection results by the second sensor 215*b* are initialized at 51614, and it is judged whether a print medium S to be discharged remains (S1616). At 51614, the histories of detection results of the first sensor 215*a* and the second sensor 215*b* may be initialized. Since the detailed process contents in S1616 are the same as those in S1712, description thereof is omitted. If it is judged at S1616 that a print medium S to be discharged remains, the process returns to S1606. If it is judged at S1616 that no print medium S to be discharged remains, this full-stack detection process ends.

If it is judged at S1612 that the stack amount is less than the nearly full stack amount, it is judged whether the size of the print medium S printed in the print operation is one of A5 size and STMT size (S1618). If it is judged at S1618 that the size of the print medium S is neither A5 size nor STMT size, the histories of detection results of the first sensor 215*a* and the second sensor 215*b* are initialized at S1620, and the process proceeds to S1616. If it is judged at S1618 that the size of the print medium S is one of A5 size and STMT size, the arm 90 is moved from the detecting position to the evacuation position at S1622, and a small-size stack amount detection process is performed at S1624.

Figures 18, 18A:
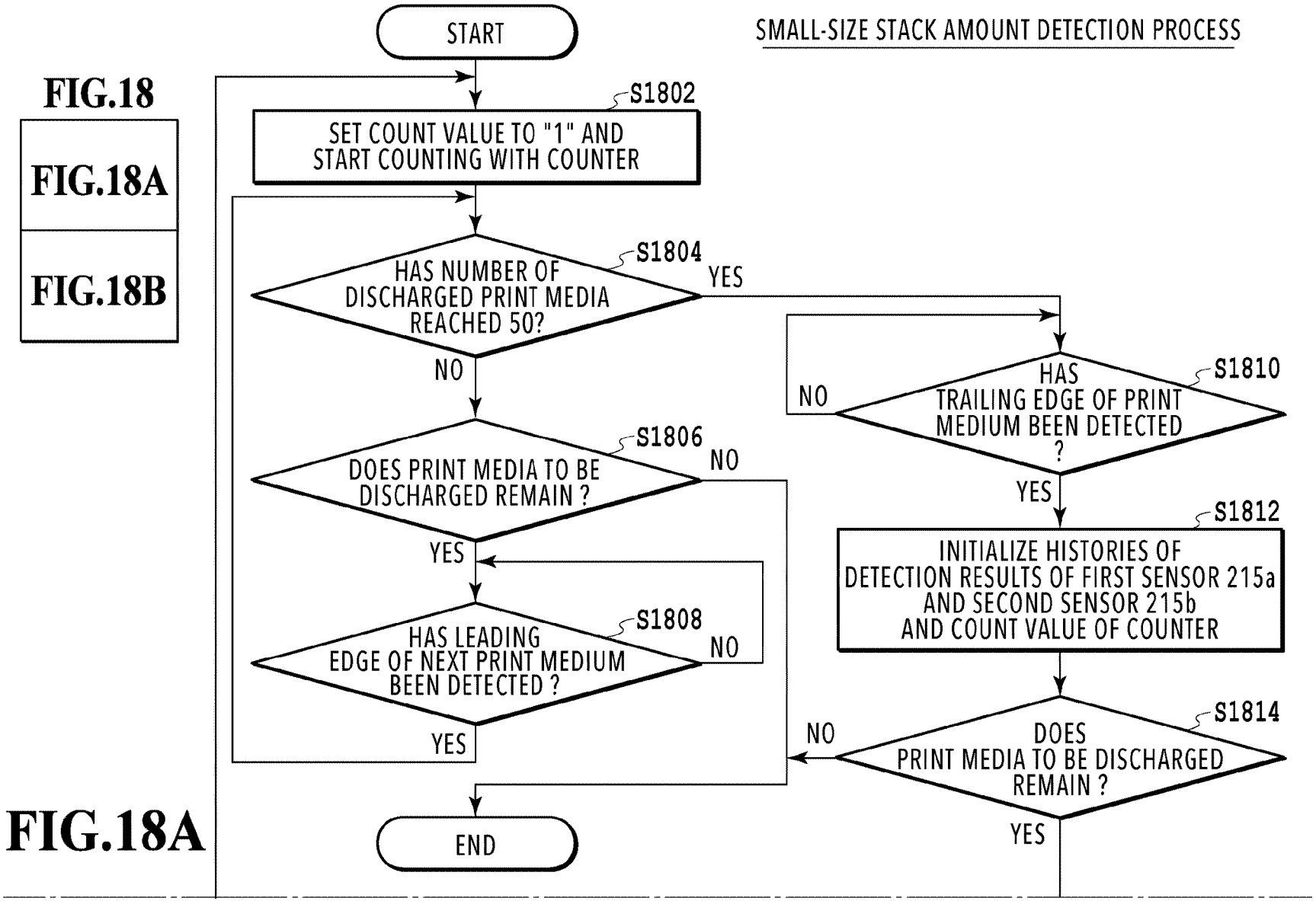
FIG. 18 is diagram showing the relationship between FIG. 18A and FIG. 18B.
FIGS. 18A and 18B are flowcharts illustrating a detailed process routine for a small-size stack amount detection process.
Figure 18B:
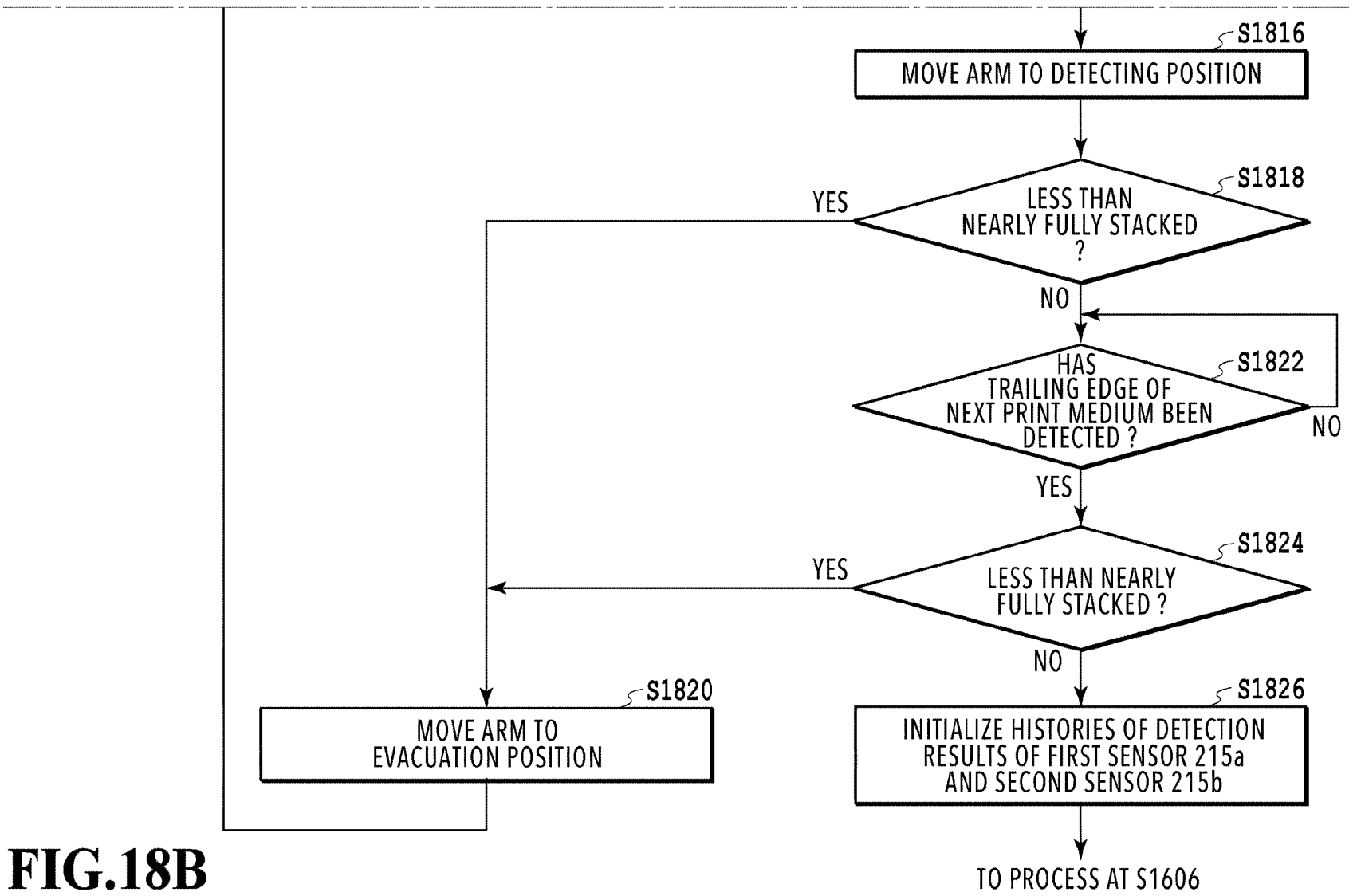

Here, FIG. 18 is a flowchart illustrating the detailed process contents of the small-size stack amount detection process at S1624. When the small-size stack amount detection process starts, first, at S1802, a count value in the counter 216 is set to "1", and counting by the counter 216 starts. Next, it is judged whether the number of print media S discharged after the small-size stack amount detection process starts has reached 50 (S1804). In other words, it is judged at S1804 whether the count value in the counter 216 has reached "50".

If it is judged at S1804 that the number of discharged print media S has not reach 50, it is judged whether a print medium S to be discharged remains (S1806). Since the detailed process contents in S1806 are the same as those in S1712, description thereof is omitted. If it is judged at S1806 that no print medium S to be discharged remains, this small-size stack amount detection process ends, and the full-stack detection process ends. If it is judged at S1806 that a print medium S to be discharged remains, it is judged whether the leading edge of the next print medium S has been detected (S1808). Specifically, when this judgment process is being performed, the detection member 20E has not yet detected the trailing edge of the print medium S the leading edge of which has been detected at S1606. Thus, at S1808, it is judged whether after the detection member 20E detects the trailing edge of a print medium S, the leading edge of the next print medium S to be discharged subsequent to this preceding print medium S has been detected. If it is judged at S1808 that the leading edge of the next print medium S has been detected, the process returns to S1804.

Note that if the leading edge of the next print medium S is detected at S1808, the counter 216 adds "1" to the count value.

On the other hand, if it is judged at S1804 that the number of discharged print media S has reached 50, it is judged whether the detection member 20E has detected the trailing edge of the print medium S (S1810). If it is judged at S1810 that the trailing edge of the print medium S has been detected, the histories of detection results of the first sensor 215*a* and the second sensor 215*b* and the count value of the counter 216 are initialized at S1812.

Next, it is judged whether a print medium S to be discharged remains (S1814). Since the detailed process contents in S1814 are the same as those in S1712, description thereof is omitted. If it is judged at S1814 that no print medium S to be discharged remains, this small-size stack amount detection process ends, and the full-stack detection process ends. If it is judged at S1814 that a print medium S to be discharged remains, the arm 90 is moved from the evacuation position to the detecting position at S1816, and it is judged whether the stack amount is less than the nearly full stack amount (S1818). Since the detailed process contents in S1818 are the same as those in S1612, description thereof is omitted.

If it is judged at S1818 that the stack amount is less than the nearly full stack amount, the arm 90 is moved from the detecting position to the evacuation position at S1820, and the process returns to S1802. If it is judged at S1818 that the stack amount is not less than the nearly full stack amount, it is judged whether the trailing edge of the next print medium S has been detected (S1822). If it is judged S1822 that the trailing edge of the next print medium S has been detected, it is judged again whether the stack amount is less than the nearly full stack amount (S1824). Since the detailed process contents in S1824 are the same as those in S1612, description thereof is omitted.

When the arm 90 is moved to the detecting position at S1816, if the print medium Ss to be discharged subsequent to the print medium Sf the trailing edge of which was detected at S1810 is in contact with the arm 90, the arm 90 cannot detect accurately whether the amount of the stack on the discharging tray 13 is less than the nearly full stack amount. For this reason, in the present embodiment, it is judged whether the trailing edge of the print medium Ss has been detected (S1822), and when the print medium St next to the print medium Ss is discharged, it is judged again whether the stack amount is less than the nearly full stack amount (S1824). This operation makes it possible to judge accurately whether the amount of a stack of print media S on the discharging tray 13 is less than the nearly full stack amount.

If it is judged at S1824 that the stack amount is less than the nearly full stack amount, the process proceeds to S1820. If it is judged at S1824 that the stack amount is not less than the nearly full stack amount, the histories of detection results of the first sensor 215*a* and the second sensor 215*b* are initialized at S1826, and the process returns to S1606.

As has been described above, to detect the amount of a stack of discharged print media S on the discharging tray 13, the printing apparatus 1 has the arm 90 that is capable of detecting the amount of the stack of the print media S while being in contact with the print media S discharged on the discharging tray 13. In addition, in the full-stack detection process for detecting whether the print media S are fully stacked on the discharging tray 13, if the print media S are of a small size, and the stack amount is less than a specified amount, the arm 90 is positioned at the evacuation position in discharging. Then, after a specified number of print media S are discharged, the arm 90 is moved to the detecting position so that the arm 90 can detect the amount of the stack of print media S on the discharging tray 13.

This allows print media S to be stacked in an orderly fashion approximately at the same position in the printing apparatus 1 without decreasing the orderly stacking property of the print media S stacked on the discharging tray 13 while the printing apparatus 1 is performing the full-stack detection process even in a case where the print media S on which printing is performed are of a small size. In addition, the printing apparatus 1 can perform printing in a shorter time than in a technique in patent document 1 in which the operation of bringing the arm into contact with a print medium and then retracting it is performed for every print medium being discharged. (Other Embodiments)

Note that the above embodiment may be modified as shown in the following (1) to (4).

(1) Although in the above embodiment, in a case where the amount of a stack of print media S on the discharging tray 13 is less than a specified amount in the full-stack detection process, if the print medium S is of a specified size, the arm 90 is moved to the evacuation position before the print medium S is discharged, the present invention is not limited to this operation. Specifically, in a case where the amount of a stack of print media S is less than a specified amount, the arm 90 may be moved to the evacuation position regardless of the size of the print medium S, and after a specified number of print media S are discharged, the arm 90 may detect the amount of the stack of print media S.

(2) Although in the above embodiment, in a case where the size of the print media S is A5 size or STMT size, the small-size stack amount detection process is performed, the present invention is not limited to this operation. In addition, although in the above embodiment, the number of discharged print media S used as the judging criteria in the small-size stack amount detection process for the timing at which the arm 90 is moved to the detecting position to detect the amount of the stack of print media S is 50, the present invention is not limited to 50. Specifically, it may be any number as long as the thickness of print media S stacked in the set number is smaller than or equal to the difference between the thickness of print media S fully stacked on the discharging tray 13 and the specified amount used for the judging criteria for the timing at which the arm 90 is moved to the evacuation position.

(3) Although the above embodiment includes the first sensor 215*a*, the second sensor 215*b*, the first flag 96*a*, and the second flag 96*b*, and the stack amount is detected based on the detection results of the first sensor 215*a* and the second sensor 215*b*, the present invention is not limited to this configuration. Specifically, three or more sensors 215 and flags associated with the sensors 215 may be provided to detect the stack amount in more detail based on the detection results of the sensors 215. Although in the above embodiment, the arm 90 is displaced by rotation, the present invention is not limited to this configuration. Specifically, the arm 90 may be displaced by any kind of movement as long as the arm 90 does not obstruct the movement of the print medium S being discharged, and the arm 90 is capable of detecting the stack amount at the position where the arm 90 is displaced.

(4) Although in the above embodiment, the printing apparatus 1 is an inkjet printing apparatus of a full line type, the present invention is not limited to this type. Specifically, the printing apparatus 1 may be an inkjet printing apparatus of a serial type. In addition, although the printing apparatus 1 performs printing by an inkjet method, the present invention is not limited to this method. Various known techniques can be used for the printing method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-096113 filed May 18, 2018, which is hereby incorporated by reference wherein in its entirety.

What is claimed is:

1. A sheet stacking apparatus comprising:

a stacking unit configured to stack a sheet conveyed to the stacking unit by a conveying unit;

a contact member configured to be in contact with the sheet stacked on the stacking unit, the position of the contact member being changed according to an amount of a stack of sheets on the stacking unit; and a movement unit configured to move the contact member to an evacuation position where the contact member does not come into contact with the sheet being discharged onto the stacking unit, wherein the sheet stacking apparatus is configured to perform a first operation in which while a specified number of sheets are discharged onto the stacking unit, the contact member is positioned at the evacuation position, and then the movement unit releases the state of the contact member at the evacuation position to bring the contact member into contact with the sheet on the stacking unit, in order for a detection of a position of the contact member in contact with the sheet on the stacking unit by a detection unit and the movement unit moves the contact member to an evacuation position where the contact member does not come into contact with the sheet being discharged onto the stacking unit before the sheet is discharged onto the stacking unit; and a second operation in which while the sheet is being discharged onto the stacking unit, the contact member is in contact with the sheet on the stacking unit, in order for a detection of a position of the contact member being in contact with the sheet on the stacking unit by a detection unit.

2. The sheet stacking apparatus according to claim 1, wherein in a case where the amount of the stack is less than a specified amount, the sheet stacking apparatus performs the first operation, and in a case where the amount of the stack is more than or equal to the specified amount, the sheet stacking apparatus performs the second operation.

3. The sheet stacking apparatus according to claim 2, wherein the specified amount is an amount at which a sheet being discharged onto the stacking unit does not push out a sheet stacked on the stacking unit to an amount exceeding an allowable amount.

4. The sheet stacking apparatus according to claim 3, wherein the specified amount is different for a type of a sheet and a structure of the apparatus.

5. The sheet stacking apparatus according to claim 2, wherein the specified amount is defined by a length extending vertically from a surface of the stacking unit on which print media are stacked.

6. The sheet stacking apparatus according to claim 2, wherein an amount corresponding to the specified number of sheets is less than or equal to a difference between an amount corresponding to a full stack and the specified amount.

7. The sheet stacking apparatus according to claim 1, wherein the detection unit includes multiple sensors and detects the amount of the stack based on a detection result by the multiple sensors.

8. The sheet stacking apparatus according to claim 7, wherein the detection unit refers to a history of detection results of each sensor to detect the amount of the stack.

9. The sheet stacking apparatus according to claim 1, wherein in a case where a sheet is of a specified size, the sheet stacking apparatus performs the first operation or the second operation based on the amount of the stack.

10. The sheet stacking apparatus according to claim 9, wherein the specified size is A5 size or statement size.

11. The sheet stacking apparatus according to claim 10, wherein in a case where the contact member is in contact with a sheet stacked on the stacking unit, the contact member is rotatable in a direction that allows movement of a sheet being discharged.

12. The sheet stacking apparatus according to claim 9, wherein in a case where a sheet is larger than the specified size, the sheet stacking apparatus performs the second operation and does not perform the first operation.

13. The sheet stacking apparatus according to claim 1, wherein a second operation in which the detection unit detects an amount of the stack using the contact member in contact with print media stacked on the stacking unit while the print media is discharging onto the stacking unit.

14. The sheet stacking apparatus according to claim 1, wherein in a case where an amount of sheets stacked on the stacking unit is a first amount and a surface of the sheet at a top stacked on the stacking unit is in contact with the contact member in contact with the surface, an acute angle at an upstream side in a direction in which the sheet is conveyed to the stacking unit by the conveying unit is a first angle, and in a case where the amount of the sheets stacked on the stacking unit is a second amount, which is more than the first amount, and the surface of the sheet at the top stacked on the stacking unit is in contact with the contact member in contact with the surface, an acute angle at an upstream side in a direction in which the sheet is conveyed to the stacking unit by the conveying unit of angles formed by the surface and the contact member is a second angle smaller than the first angle.

15. The sheet stacking apparatus according to claim 1, wherein the contact member rotates according to the amount of the stack of the print media, wherein the detection unit detects the amount of the stack by detecting the rotation of the contact member.

16. The sheet stacking apparatus according to claim 15, further comprising a flag configured to rotate with the rotation of the contact member, wherein the detection unit has a light emitting portion emitting light and a light receiving portion receiving the light from the light emitting portion, the light emitted from the light emitting portion is passed through or blocked according to the rotation of the flag, and the amount of the stack is detected based on the amount of light received by the light receiving portion.

17. The sheet stacking apparatus according to claim 1, wherein the sheet stacking apparatus determines whether to perform the first operation or to perform the second operation, based on the amount of the stack detected by the detection unit.

18. The sheet stacking apparatus according to claim 1, further comprising a print head configured to perform printing on a sheet, and wherein the sheet is conveyed to the stacking unit.

19. The sheet stacking apparatus according to claim 1, further comprising a detection unit for a detecting a position of the contact member in contact with the sheet on the stacking unit.

20. The sheet stacking apparatus according to claim 19, wherein the detection unit detects the position of the contact member in contact with the sheet on the stacking unit for obtaining information on an amount of the stack of sheets on the stacking unit.

21. The sheet stacking apparatus according to claim 1, wherein when the contact member is in contact with the sheet stacked on the stacking unit, the contact member is in contact with a surface of the sheet at a top stacked on the stacking unit.

22. A stacking method comprising:

discharging a sheet to a stacking unit configured to stack the sheet;

detecting the amount of the stack based on a position of a contact member in contact with the sheet stacked on the stacking unit, the position of the contact member being changed according to the amount of a stack of sheets on the stacking unit;

moving the contact member to an evacuation position where the contact member does not come into contact with a sheet being discharged onto the stacking unit;

wherein in the detecting, a first operation and a second operation are performed, the first operation is an operation of, while a specified number of sheets are discharged onto the stacking unit, positioning the contact member at the evacuation position and then moving the contact member to come into contact with the sheet on the staking unit in order to detect an amount of the stack of sheets on the stacking unit using the contact member, and moving the contact member to the evacuation position where the contact member does not come into contact with the sheet being discharged onto the stacking unit before sheets are discharged onto the stacking unit; and the second operation is an operation of causing the contact member to be in contact with the sheet on the stacking unit while the sheet is being discharged, in order to detect an amount of the stack of sheets on the stacking unit using the contact member.

23. The stacking method according to claim 22, wherein in a case where the amount of the stack is less than a specified amount, performing the first operation, and in a case where the amount of the stack is more than or equal to the specified amount, performing the second operation.

24. The stacking method according to claim 23, wherein the specified amount is an amount at which a sheet being discharged onto the stacking unit does not push out a sheet stacked on the stacking unit to an amount exceeding an allowable amount.

25. A sheet stacking apparatus comprising:

a stacking unit configured to stack a sheet conveyed to the stacking unit by a conveying unit;

a contact member configured to be in contact with the sheet stacked on the stacking unit and change position according to an amount of a stack of sheets; and a movement unit configured to move the contact member to an evacuation position where the contact member does not come into contact with the sheet being discharged onto the stacking unit, wherein the sheet stacking apparatus is configured to perform a first operation in which while a specified number of sheets are discharged onto the stacking unit, the contact member is positioned at the evacuation position, and then the movement unit releases the state of the contact member at the evacuation position for bringing the contact member into contact with the sheets on the stacking unit, and the movement unit moves the contact member to an evacuation position where the contact member does not come into contact with the sheets being discharged onto the stacking unit before the sheets are discharged onto the stacking unit, and a second operation in which while the sheets are being discharged onto the stacking unit, the contact member is in contact with the sheets on the stacking unit.

* * * * *